US010734006B2

(12) United States Patent
Mirzahasanloo et al.

(10) Patent No.: US 10,734,006 B2
(45) Date of Patent: Aug. 4, 2020

(54) AUDIO CODING BASED ON AUDIO PATTERN RECOGNITION

(71) Applicant: QUALCOMM Incorporated, San Diego, CA (US)

(72) Inventors: Taher Shahbazi Mirzahasanloo, San Diego, CA (US); Rogerio Guedes Alves, Macomb Township, MI (US)

(73) Assignee: Qualcomm Incorporated, San Diego, CA (US)

( * ) Notice: Subject to any disclaimer, the term of this patent is extended or adjusted under 35 U.S.C. 154(b) by 35 days.

(21) Appl. No.: 16/051,007

(22) Filed: Jul. 31, 2018

(65) Prior Publication Data

US 2019/0371349 A1 Dec. 5, 2019

Related U.S. Application Data

(60) Provisional application No. 62/679,271, filed on Jun. 1, 2018.

(51) Int. Cl.

| | |
|---|---|
| ***G10L 19/038*** | (2013.01) |
| ***G10L 19/13*** | (2013.01) |
| ***G10L 19/07*** | (2013.01) |

(52) U.S. Cl.

CPC ..... *G10L 19/038* (2013.01); *G10L 19/07* (2013.01); *G10L 19/13* (2013.01)

(58) Field of Classification Search

None

See application file for complete search history.

(56) References Cited

U.S. PATENT DOCUMENTS

| | | | | |
|---|---|---|---|---|
| 5,150,387 | A | 9/1992 | Yoshikawa et al. | |
| 5,241,535 | A | 8/1993 | Yoshikawa | |
| 5,594,833 | A | 1/1997 | Miyazawa et al. | |
| 5,987,407 | A * | 11/1999 | Wu | G10L 19/26 704/200.1 |
| 6,567,781 | B1 | 5/2003 | Lafe | |
| 6,574,593 | B1 | 6/2003 | Gao et al. | |

(Continued)

FOREIGN PATENT DOCUMENTS

| | | | |
|---|---|---|---|
| CN | 101145787 | A | 3/2008 |
| WO | 2015162500 | A2 | 10/2015 |

OTHER PUBLICATIONS

"Bluetooth Core Specification v 5.0," published Dec. 6, 2016 accessed from https://www.bluetooth.com/specifications, 5 pp.

(Continued)

*Primary Examiner* — Abul K Azad

(74) *Attorney, Agent, or Firm* — Shumaker & Sieffert, P.A.

(57) ABSTRACT

In general, techniques are described by which to perform audio coding based on audio pattern recognition. A source device comprising a memory and a processor may be configured to perform the techniques. The memory may store audio data. The processor may obtain, from a plurality of categories, a category to which the audio data corresponds, and obtain, based on the category, a set of pyramid vector quantization (PVQ) parameters from a plurality of sets of PVQ parameters. The processor may also perform, based on the set of PVQ parameters, PVQ with respect to the audio data to obtain a residual identifier representative of the audio data, and specify, in the bitstream, the residual identifier.

26 Claims, 9 Drawing Sheets

(56) References Cited

U.S. PATENT DOCUMENTS

| | | | |
|---|---|---|---|
| 6,725,192 | B1 | 4/2004 | Araki |
| 6,735,339 | B1 | 5/2004 | Ubale |
| 7,139,702 | B2 | 11/2006 | Tsushima et al. |
| 7,499,898 | B1 | 3/2009 | Owen et al. |
| 7,689,427 | B2 | 3/2010 | Vasilache |
| 7,702,514 | B2 | 4/2010 | Lin et al. |
| 7,904,293 | B2 | 3/2011 | Wang et al. |
| 8,396,163 | B2 | 3/2013 | Collings et al. |
| 8,694,325 | B2 | 4/2014 | Lin et al. |
| 9,015,052 | B2 | 4/2015 | Lin et al. |
| 9,159,331 | B2 | 10/2015 | Kim et al. |
| 9,263,050 | B2 | 2/2016 | Daniel et al. |
| 9,546,924 | B2 | 1/2017 | Grancharov et al. |
| 9,754,594 | B2 | 9/2017 | Liu et al. |
| 9,972,334 | B2 | 5/2018 | Subasingha et al. |
| 10,032,281 | B1 | 7/2018 | Ghesu et al. |
| 10,573,331 | B2 * | 2/2020 | Shahbazi Mirzahasanloo ..... G10L 25/18 |
| 2001/0049598 | A1 | 12/2001 | Das |
| 2002/0111704 | A1 | 8/2002 | Suzuki |
| 2004/0002859 | A1 | 1/2004 | Liu et al. |
| 2006/0270347 | A1 | 11/2006 | Ibrahim et al. |
| 2007/0033057 | A1 | 2/2007 | Covell et al. |
| 2007/0093206 | A1 | 4/2007 | Desai et al. |
| 2007/0198256 | A1 | 8/2007 | Hu et al. |
| 2007/0286524 | A1 | 12/2007 | Song |
| 2010/0174531 | A1 | 7/2010 | Bernard Vos |
| 2011/0178807 | A1 | 7/2011 | Yang et al. |
| 2012/0226505 | A1 | 9/2012 | Lin et al. |
| 2012/0232913 | A1 | 9/2012 | Terriberry et al. |
| 2012/0259644 | A1 | 10/2012 | Lin et al. |
| 2012/0296658 | A1 | 11/2012 | Smyth |
| 2012/0323582 | A1 | 12/2012 | Peng et al. |
| 2013/0060365 | A1 | 3/2013 | Jeong et al. |
| 2013/0275140 | A1 | 10/2013 | Kim et al. |
| 2014/0039890 | A1 | 2/2014 | Mundt et al. |
| 2014/0046670 | A1 | 2/2014 | Moon et al. |
| 2014/0052439 | A1 | 2/2014 | Rose et al. |
| 2014/0052678 | A1 | 2/2014 | Martinez et al. |
| 2014/0156284 | A1 | 6/2014 | Porov et al. |
| 2015/0073784 | A1 | 3/2015 | Gao |
| 2015/0317991 | A1 | 11/2015 | Liu et al. |
| 2016/0027449 | A1 | 1/2016 | Svedberg |
| 2016/0049157 | A1 * | 2/2016 | Mittal ..... H03M 7/3082 704/500 |
| 2016/0088297 | A1 * | 3/2016 | Svedberg ..... G10L 19/00 375/240.03 |
| 2016/0189722 | A1 | 6/2016 | Nagisetty et al. |
| 2016/0232910 | A1 | 8/2016 | Fischer et al. |
| 2016/0254004 | A1 | 9/2016 | Norvell et al. |
| 2016/0275955 | A1 | 9/2016 | Liu et al. |
| 2016/0307578 | A1 | 10/2016 | Rose et al. |
| 2017/0069328 | A1 | 3/2017 | Kawashima et al. |
| 2017/0084280 | A1 | 3/2017 | Srinivasan et al. |
| 2017/0147949 | A1 | 5/2017 | Uchibe et al. |
| 2017/0213151 | A1 | 7/2017 | Uchibe et al. |
| 2017/0223356 | A1 | 8/2017 | Sung et al. |
| 2017/0228655 | A1 | 8/2017 | Alarie et al. |
| 2017/0301359 | A1 | 10/2017 | Svedberg |
| 2017/0365260 | A1 | 12/2017 | Chebiyyam et al. |
| 2018/0061428 | A1 | 3/2018 | Seroussi et al. |
| 2018/0182400 | A1 | 6/2018 | Choo et al. |
| 2018/0288182 | A1 | 10/2018 | Tong et al. |
| 2018/0374495 | A1 | 12/2018 | Fienberg et al. |
| 2019/0156844 | A1 | 5/2019 | Fischer et al. |
| 2019/0230438 | A1 | 7/2019 | Hatab et al. |
| 2019/0279651 | A1 * | 9/2019 | Svedberg ..... G10L 19/06 |

OTHER PUBLICATIONS

"Advanced Audio Distribution Profile Specification," version 1.3.1, published Jul. 14, 2015, 35 pp.

Hung, et al., "Error-resilient pyramid vector quantization for image compression," IEEE Transactions on Image Processing, vol. 7, No. 10, Oct. 1998, pp. 1373-1386.

Chou, et al., "Vertex Data Compression through Vector Quantization," IEEE Transactions on Visualization and Computer Graphics, vol. 8, No. 4, Oct.-Dec. 2002, pp. 373-382.

Svedberg et al., "MDCT Audio Coding with Pulse Vector Quantizers," 2015 IEEE International Conference on Acoustics, Speech, and Signal Processing, Apr. 2015, accessed from https://www.ericsson.com/assets/local/publications/conference-papers/mdct_audio_coding_with_pulse_vector_quantizers.pdf, 5 pp.

Sutton et al., "Chapter 13: Policy Gradient Methods," Reinforcement Learning: An Introduction, second edition, Nov. 2018, pp. 323-340.

Fischer, "A pyramid vector quantizer," IEEE Transactions on Information Theory, vol. 32 No. 4, Jul. 1986, pp. 568-583.

Hong, "Unsupervised Feature Selection Using Clustering Ensembles and Population Based Incremental Learning Algorithm," Dec. 20, 2007, 32 pp.

Bishop, "Pattern Recognition and Machine Learning" Information Science and Statistics, published Apr. 2011, 758 pp.

U.S. Appl. No. 16/050,894, filed by Taher Shahbazi Mirzahasanloo et al., [Qualcomm, Inc.], filed Jul. 31, 2018.

U.S. Appl. No. 16/050,844, filed by Taher Shahbazi Mirzahasanloo et al., [Qualcomm, Inc.], filed Jul. 31, 2018.

U.S. Appl. No. 16/050,966, filed by Taher Shahbazi Mirzahasanloo et al., [Qualcomm, Inc.], filed Jul. 31, 2018.

* cited by examiner

AUDIO CODING BASED ON AUDIO PATTERN RECOGNITION

This disclosure claims the benefit of U.S. Provisional Application No. 62/679,271, filed Jun. 1, 2018, the entire contents of which is hereby incorporated by reference in its entirety.

TECHNICAL FIELD

This disclosure relates to audio encoding and decoding.

BACKGROUND

Wireless networks for short-range communication, which may be referred to as "personal area networks," are established to facilitate communication between a source device and a sink device. One example of a personal area network (PAN) protocol is Bluetooth®, which is often used to form a PAN for streaming audio data from the source device (e.g., a mobile phone) to the sink device (e.g., headphones or a speaker).

In some examples, the Bluetooth® protocol is used for streaming encoded or otherwise compressed audio data. In some examples, audio data is encoded using gain-shape vector quantization audio encoding techniques. In gain-shape vector quantization audio encoding, audio data is transformed into the frequency domain and then separated into subbands of transform coefficients. A scalar energy level (e.g., gain) of each subband is encoded separately from the shape (e.g., a residual vector of transform coefficients) of the subband.

SUMMARY

In general, this disclosure relates to techniques by which to adapt application of pyramid vector quantization (PVQ) based on a classification of audio data. Rather than utilize a single codebook for all classes of audio data, the techniques may allow audio coders to select between a number of different codebooks, each of which has been adapted to promote more efficient representation (in terms of bits used versus quantization loss) of the residual vector for the particular class to which each codebook is associated. In this respect, the audio encoder may achieve more efficient representations of the residual vectors for each subband, promoting better coding efficiency (e.g., more compact bitstreams) and better perceptual quality upon playback (e.g., due to less quantization noise or loss).

In one aspect, the techniques are directed to a source device configured to process audio data to obtain a bitstream, the source device comprising: a memory configured to store the audio data; and one or more processors configured to: obtain, from a plurality of categories, a category to which the audio data corresponds; obtain, based on the category, a set of pyramid vector quantization (PVQ) parameters from a plurality of sets of PVQ parameters; perform, based on the set of PVQ parameters, PVQ with respect to the audio data to obtain a residual identifier representative of the audio data; and specify, in the bitstream, the residual identifier.

In another aspect, the techniques are directed to a method of processing audio data to obtain a bitstream, the method comprising: obtaining, from a plurality of categories, a category to which the audio data corresponds; obtaining, based on the category, a set of pyramid vector quantization (PVQ) parameters from a plurality of sets of PVQ parameters; performing, based on the set of PVQ parameters, PVQ with respect to the audio data to obtain a residual identifier representative of the audio data; and specifying, in the bitstream, the residual identifier.

In another aspect, the techniques are directed to an apparatus for processing audio data to obtain a bitstream, the method comprising: means for obtaining, from a plurality of categories, a category to which the audio data corresponds; means for obtaining, based on the category, a set of pyramid vector quantization (PVQ) parameters from a plurality of sets of PVQ parameters; means for performing, based on the set of PVQ parameters, PVQ with respect to the audio data to obtain a residual identifier representative of the audio data; and means for specifying, in the bitstream, the residual identifier.

In another aspect, the techniques are directed to a computer-readable medium having stored thereon instructions that, when executed, cause one or more processors to: obtain, from a plurality of categories, a category to which audio data corresponds; obtain, based on the category, a set of pyramid vector quantization (PVQ) parameters from a plurality of sets of PVQ parameters; perform, based on the set of PVQ parameters, PVQ with respect to the audio data to obtain a residual identifier representative of the audio data; and specify, in the bitstream, the residual identifier.

In another aspect, the techniques are directed to a sink device configured to process a bitstream representative of audio data, the sink device comprising: a memory configured to store at least a portion of the bitstream; and one or more processors configured to: obtain, from the bitstream, a residual identifier representative of the audio data; obtain, from the bitstream, an indication of pyramid vector quantization (PVQ) parameters; obtain, from a plurality of sets of inverse PVQ parameters and based on the indication, a set of inverse PVQ parameters; and perform, based on the set of inverse PVQ parameters, inverse PVQ with respect to the residual identifier to obtain the audio data.

In another aspect, the techniques are directed to a method of processing a bitstream representative of audio data, the method comprising: obtaining, from the bitstream, a residual identifier representative of the audio data; obtaining, from the bitstream, an indication of pyramid vector quantization (PVQ) parameters; obtaining, from a plurality of sets of inverse PVQ parameters and based on the indication, a set of inverse PVQ parameters; and performing, based on the set of inverse PVQ parameters, inverse PVQ with respect to the residual identifier to obtain the audio data.

In another aspect, the techniques are directed to an apparatus for processing a bitstream representative of audio data, the method comprising: means for obtaining, from the bitstream, a residual identifier representative of the audio data; means for obtaining, from the bitstream, an indication of pyramid vector quantization (PVQ) parameters; means for obtaining, from a plurality of sets of inverse PVQ parameters and based on the indication, a set of inverse PVQ parameters; and means for performing, based on the set of inverse PVQ parameters, inverse PVQ with respect to the residual identifier to obtain the audio data.

In another aspect, the techniques are directed to a computer-readable medium having stored thereon instructions that, when executed, cause one or more processors to: obtain, from the bitstream, a residual identifier representative of audio data; obtain, from the bitstream, an indication of pyramid vector quantization (PVQ) parameters; obtain, from a plurality of sets of inverse PVQ parameters and based on the indication, a set of inverse PVQ parameters; and perform, based on the set of inverse PVQ parameters, inverse PVQ with respect to the residual identifier to obtain the audio data.

The details of one or more aspects of the techniques are set forth in the accompanying drawings and the description below. Other features, objects, and advantages of these techniques will be apparent from the description and drawings, and from the claims.

DETAILED DESCRIPTION

Figure 1:
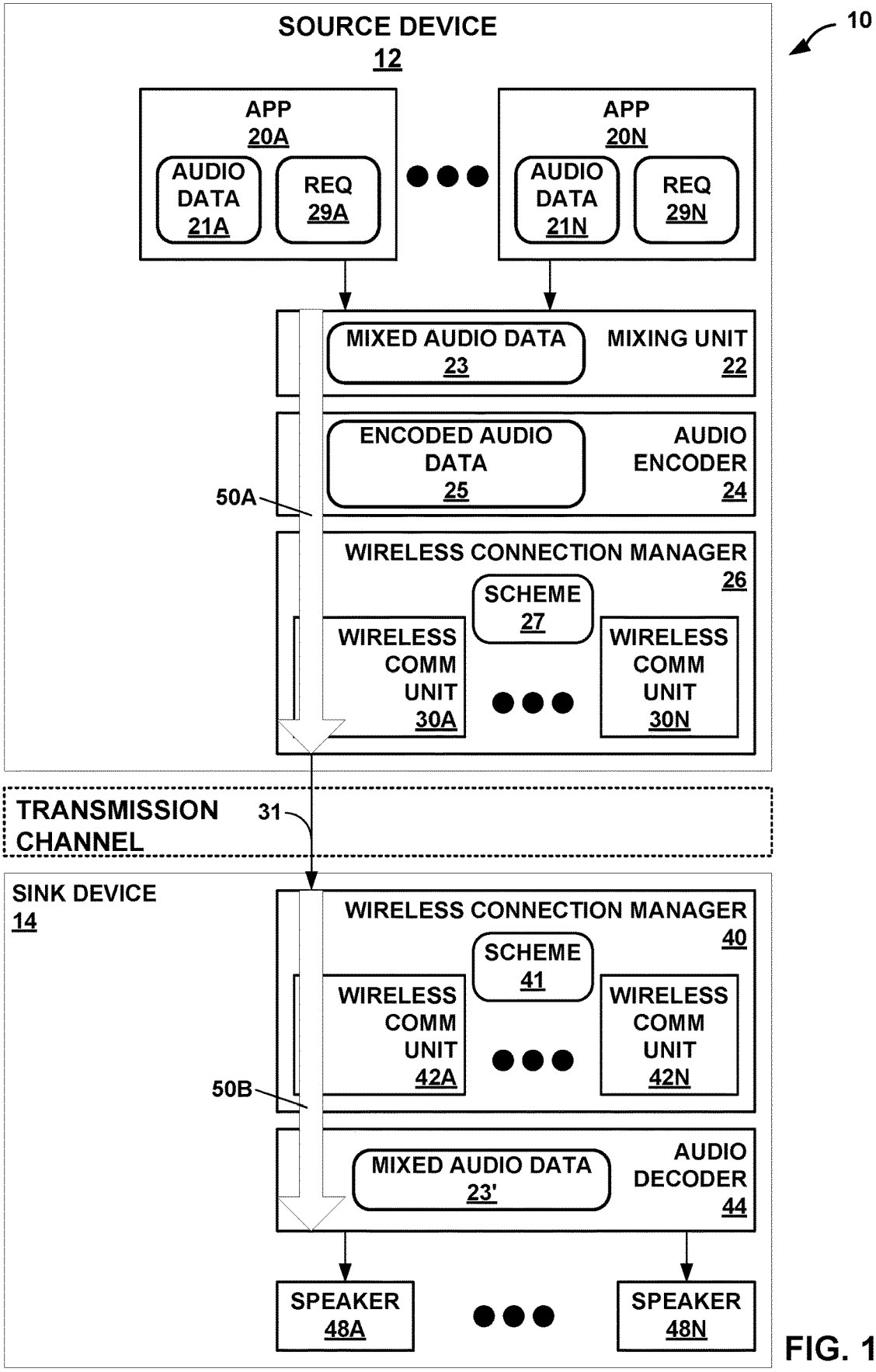
FIG. 1 is a block diagram illustrating a system that may perform various aspects of the techniques described in this disclosure.

FIG. 1 is a diagram illustrating a system 10 that may perform various aspects of the techniques described in this disclosure for adapting pyramid vector quantization (PVQ) using audio pattern recognition. As shown in the example of FIG. 1, the system 10 includes a source device 12 and a sink device 14. Although described with respect to the source device 12 and the sink device 14, the source device 12 may operate, in some instances, as the sink device, and the sink device 14 may, in these and other instances, operate as the source device. As such, the example of system 10 shown in FIG. 1 is merely one example illustrative of various aspects of the techniques described in this disclosure.

In any event, the source device 12 may represent any form of computing device capable of implementing the techniques described in this disclosure, including a handset (or cellular phone), a tablet computer, a so-called smart phone, a remotely piloted aircraft (such as a so-called "drone"), a robot, a desktop computer, a receiver (such as an audio/visual—AV—receiver), a set-top box, a television (including so-called "smart televisions"), a media player (such as a digital video disc player, a streaming media player, a Blue-Ray Disc™ player, etc.), or any other device capable of communicating audio data wirelessly to a sink device via a personal area network (PAN). For purposes of illustration, the source device 12 is assumed to represent a smart phone.

The sink device 14 may represent any form of computing device capable of implementing the techniques described in this disclosure, including a handset (or cellular phone), a tablet computer, a smart phone, a desktop computer, a wireless headset (which may include wireless headphones that include or exclude a microphone, and so-called smart wireless headphones that include additional functionality such as fitness monitoring, on-board music storage and/or playback, dedicated cellular capabilities, etc.), a wireless speaker (including a so-called "smart speaker"), a watch (including a so-called "smart watch"), or any other device capable of reproducing a soundfield based on audio data communicated wirelessly via the PAN. Also, for purposes of illustration, the sink device 14 is assumed to represent wireless headphones.

As shown in the example of FIG. 1, the source device 12 includes one or more applications ("apps") 20A-20N ("apps 20"), a mixing unit 22, an audio encoder 24, and a wireless connection manager 26. Although not shown in the example of FIG. 1, the source device 12 may include a number of other elements that support operation of apps 20, including an operating system, various hardware and/or software interfaces (such as user interfaces, including graphical user interfaces), one or more processors, memory, storage devices, and the like.

Each of the apps 20 represents software (such as a collection of instructions stored to a non-transitory computer readable media) that configure the system 10 to provide some functionality when executed by the one or more processors of the source device 12. The apps 20 may, to list a few examples, provide messaging functionality (such as access to emails, text messaging, and/or video messaging), voice calling functionality, video conferencing functionality, calendar functionality, audio streaming functionality, direction functionality, mapping functionality, and gaming functionality. Apps 20 may be first party applications designed and developed by the same company that designs and sells the operating system executed by the source device 12 (and often pre-installed on the source device 12) or third-party applications accessible via a so-called "app store" or possibly pre-installed on the source device 20. Each of the apps 20, when executed, may output audio data 21A-21N ("audio data 21"), respectively. In some examples, the audio data 21 may be generated from a microphone (not pictured) connected to the source device 12.

The mixing unit 22 represents a unit configured to mix one or more of audio data 21A-21N ("audio data 21") output by the apps 20 (and other audio data output by the operating system—such as alerts or other tones, including keyboard press tones, ringtones, etc.) to generate mixed audio data 23. Audio mixing may refer to a process whereby multiple sounds (as set forth in the audio data 21) are combined into one or more channels. During mixing, the mixing unit 22 may also manipulate and/or enhance volume levels (which may also be referred to as "gain levels"), frequency content, and/or panoramic position of the audio data 21. In the context of streaming the audio data 21 over a wireless PAN session, the mixing unit 22 may output the mixed audio data 23 to the audio encoder 24.

The audio encoder 24 may represent a unit configured to encode the mixed audio data 23 and thereby obtain encoded audio data 25. In some examples, the audio encoder 24 may encode individual ones of the mixed audio data 23. Referring for purposes of illustration to one example of the PAN protocols, Bluetooth® provides for a number of different types of audio codecs (which is a word resulting from combining the words "encoding" and "decoding") and is extensible to include vendor specific audio codecs. The Advanced Audio Distribution Profile (A2DP) of Bluetooth® indicates that support for A2DP requires supporting a sub-band codec specified in A2DP. A2DP also supports codecs set forth in MPEG-1 Part 3 (MP2), MPEG-2 Part 3 (MP3), MPEG-2 Part 7 (advanced audio coding—AAC), MPEG-4 Part 3 (high efficiency-AAC—HE-AAC), and Adaptive Transform Acoustic Coding (ATRAC). Furthermore, as noted above, A2DP of Bluetooth® supports vendor specific codecs, such as aptX™ and various other versions of aptX (e.g., enhanced aptX—E-aptX, aptX live, and aptX high definition—aptX-HD).

The audio encoder 24 may operate consistent with one or more of any of the above listed audio codecs, as well as, audio codecs not listed above, but that operate to encode the mixed audio data 23 to obtain the encoded audio data 25. The audio encoder 24 may output the encoded audio data 25 to one of the wireless communication units 30 (e.g., the wireless communication unit 30A) managed by the wireless connection manager 26. The audio encoder 24 may be configured to encode the mixed audio data 21 and/or the mixed audio data 23 using a pyramid vector quantization.

The wireless connection manager 26 may represent a unit configured to allocate bandwidth within certain frequencies of the available spectrum to the different ones of the wireless communication units 30. For example, the Bluetooth® communication protocols operate over within the 2.5 GHz range of the spectrum, which overlaps with the range of the spectrum used by various WLAN communication protocols. The wireless connection manager 26 may allocate some portion of the bandwidth during a given time to the Bluetooth® protocol and different portions of the bandwidth during a different time to the overlapping WLAN protocols. The allocation of bandwidth is defined by a scheme 27. The wireless connection manager 40 may expose various application programmer interfaces (APIs) by which to adjust the allocation of bandwidth and other aspects of the communication protocols so as to achieve a specified quality of service (QoS). That is, the wireless connection manager 40 may provide the API to adjust the scheme 27 by which to control operation of the wireless communication units 30 to achieve the specified QoS.

In other words, the wireless connection manager 26 may manage coexistence of multiple wireless communication units 30 that operate within the same spectrum, such as certain WLAN communication protocols and some PAN protocols as discussed above. The wireless connection manager 26 may include the coexistence scheme 27 (shown in FIG. 1 as "scheme 27") that indicates when (e.g., an interval) and how many packets each of the wireless communication units 30 may send, the size of the packets sent, and the like.

The wireless communication units 30 may each represent a wireless communication unit 30 that operates in accordance with one or more communication protocols to communicate encoded audio data 25 via a transmission channel to the sink device 14. In the example of FIG. 1, the wireless communication unit 30A is assumed for purposes of illustration to operate in accordance with the Bluetooth® suite of communication protocols. It is further assumed that the wireless communication unit 30A operates in accordance with A2DP to establish a PAN link (over the transmission channel) to allow for delivery of the encoded audio data 25 from the source device 12 to the sink device 14.

More information concerning the Bluetooth® suite of communication protocols can be found in a document entitled "Bluetooth Core Specification v 5.0," published Dec. 6, 2016, and available at: www.bluetooth.org/en-us/specification/adopted-specifications. More information concerning A2DP can be found in a document entitled "Advanced Audio Distribution Profile Specification," version 1.3.1, published on Jul. 14, 2015.

The wireless communication unit 30A may output the encoded audio data 25 as a bitstream 31 to the sink device 14 via a transmission channel, which may be a wired or wireless channel, a data storage device, or the like. While shown in FIG. 1 as being directly transmitted to the sink device 14, the source device 12 may output the bitstream 31 to an intermediate device positioned between the source device 12 and the sink device 14. The intermediate device may store the bitstream 31 for later delivery to the sink device 14, which may request the bitstream 31. The intermediate device may comprise a file server, a web server, a desktop computer, a laptop computer, a tablet computer, a mobile phone, a smart phone, or any other device capable of storing the bitstream 31 for later retrieval by an audio decoder. This intermediate device may reside in a content delivery network capable of streaming the bitstream 31 (and possibly in conjunction with transmitting a corresponding video data bitstream) to subscribers, such as the sink device 14, requesting the bitstream 31.

Alternatively, the source device 12 may store the bitstream 31 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to those channels by which content stored to these mediums are transmitted (and may include retail stores and other store-based delivery mechanism). In any event, the techniques of this disclosure should not therefore be limited in this respect to the example of FIG. 1.

As further shown in the example of FIG. 1, the sink device 14 includes a wireless connection manager 40 that manages one or more of wireless communication units 42A-42N ("wireless communication units 42") according to a scheme 41, an audio decoder 44, and one or more speakers 48A-48N ("speakers 48"). The wireless connection manager 40 may operate in a manner similar to that described above with respect to the wireless connection manager 26, exposing an API to adjust scheme 41 by which operation of the wireless communication units 42 is controlled to achieve a specified QoS.

The wireless communication units 42 of sink device 14 may be similar in operation to the wireless communication units 30 of source device 12, except that the wireless communication units 42 operate reciprocally to the wireless communication units 30 to decapsulate the encoded audio data 25. One of the wireless communication units 42 (e.g., the wireless communication unit 42A) is assumed to operate in accordance with the Bluetooth® suite of communication protocols and reciprocal to the wireless communication protocol 28A. The wireless communication unit 42A may output the encoded audio data 25 to the audio decoder 44.

The audio decoder 44 may operate in a manner that is reciprocal to the audio encoder 24. The audio decoder 44 may operate consistent with one or more of any of the above listed audio codecs, as well as, audio codecs not listed above, but that operate to decode the encoded audio data 25 to obtain mixed audio data 23'. The prime designation with respect to "mixed audio data 23" denotes that there may be some loss due to quantization or other lossy operations that occur during encoding by the audio encoder 24. The audio decoder 44 may output the mixed audio data 23' as one or more speaker feeds to one or more of the speakers 48.

Each of the speakers 48 represents a transducer configured to reproduce a soundfield from the mixed audio data 23' (which may represent one or more speaker feeds). The transducer may be integrated within the sink device 14 as shown in the example of FIG. 1 or may be communicatively coupled to the sink device 14 (via a wire or wirelessly). The speakers 48 may represent any form of speaker, such as a loudspeaker, a headphone speaker, or a speaker in an earbud. Furthermore, although described with respect to a transducer, the speakers 48 may represent other forms of speakers, such as the "speakers" used in bone conducting headphones that send vibrations to the upper jaw, which induces sound in the human aural system.

As noted above, the apps 20 may output audio data 21 to the mixing unit 22. Prior to outputting the audio data 21, the apps 20 may interface with the operating system to initialize an audio processing path for output via integrated speakers (not shown in the example of FIG. 1) or a physical connection (such as a mini-stereo audio jack, which is also known as 3.5 millimeter—mm—minijack). As such, the audio processing path may be referred to as a wired audio processing path considering that the integrated speaker is connected by a wired connection similar to that provided by the physical connection via the mini-stereo audio jack. The wired audio processing path may represent hardware or a combination of hardware and software that processes the audio data 21 to achieve a target quality of service (QoS).

To illustrate, one of the apps 20 (which is assumed to be the app 20A for purposes of illustration) may issue, when initializing or reinitializing the wired audio processing path, one or more requests 29A for a particular QoS for the audio data 21A output by the app 20A. The request 29A may specify, as a couple of examples, a high latency (that results in high quality) wired audio processing path, a low latency (that may result in lower quality) wired audio processing path, or some intermediate latency wired audio processing path. The high latency wired audio processing path may also be referred to as a high quality wired audio processing path, while the low latency wired audio processing path may also be referred to as a low quality wired audio processing path.

Figure 2:
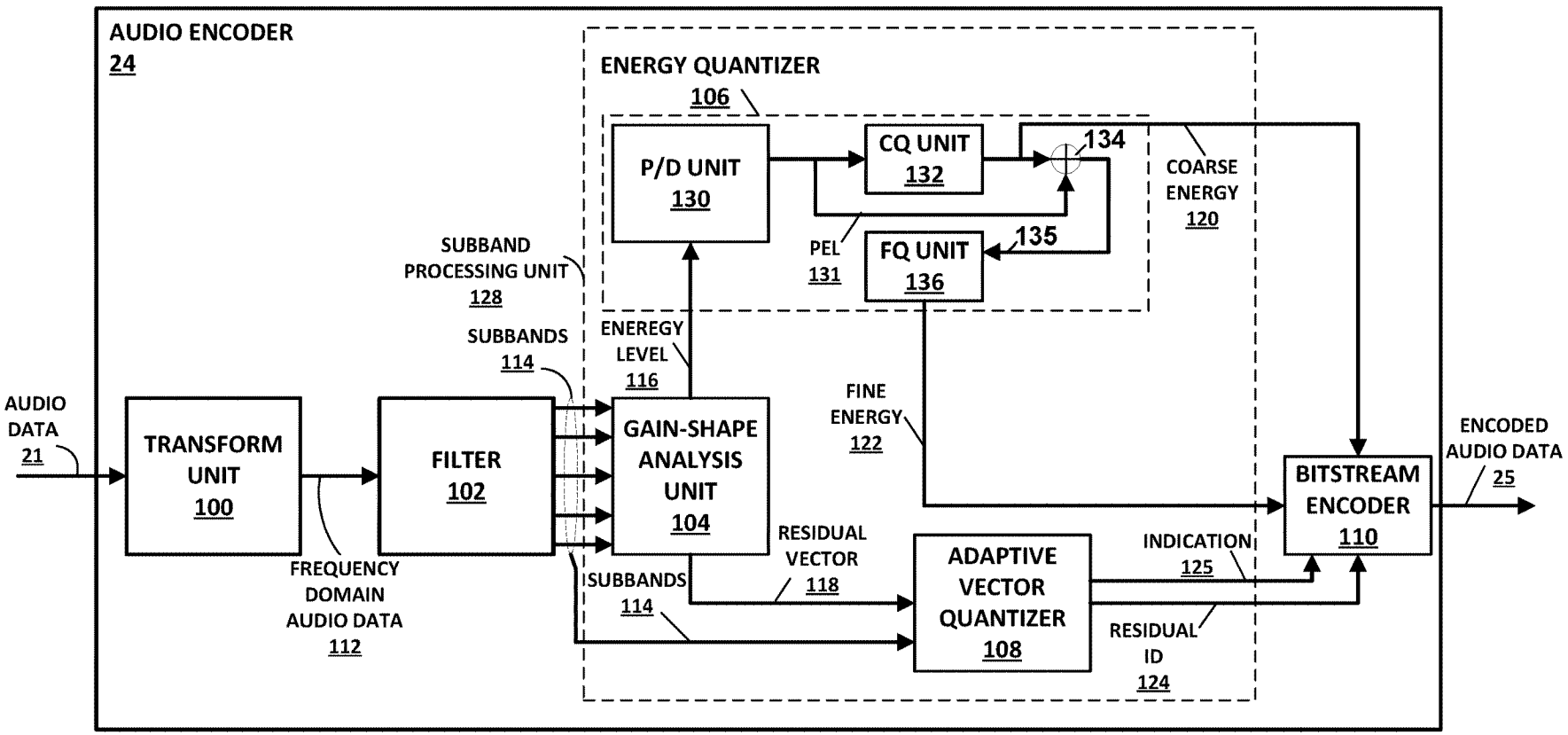
FIG. 2 is a block diagram illustrating an example audio encoder configured to perform various aspects of the techniques described in this disclosure.

FIG. 2 is a block diagram illustrating an example of an audio encoder 24 configured to perform various aspects of the techniques described in this disclosure. The audio encoder 24 may be configured to encode audio data for transmission over a PAN (e.g., Bluetooth®). However, the techniques of this disclosure performed by the audio encoder 24 may be used in any context where the compression of audio data is desired. In some examples, the audio encoder 24 may be configured to encode the audio data 21 in accordance with as aptX™ audio codec, including, e.g., enhanced aptX—E-aptX, aptX live, and aptX high definition. However, the techniques of this disclosure may be used in any audio codec. As will be explained in more detail below, the audio encoder 24 may be configured to perform various aspects of the adaptive PVQ coding techniques described in this disclosure.

In the example of FIG. 2, the audio encoder 24 may be configured to encode the audio data 21 (or the mixed audio data 23) using a gain-shape vector quantization encoding process. In a gain-shape vector quantization encoding process, the audio encoder 24 is configured to encode both a gain (e.g., an energy level) and a shape (e.g., a residual vector defined by transform coefficients) of a subband of frequency domain audio data. Each subband of frequency domain audio data represents a certain frequency range of a particular frame of the audio data 21.

The audio data 21 may be sampled at a particular sampling frequency. Example sampling frequencies may include 48 kHz or 44.1 kHZ, though any desired sampling frequency may be used. Each digital sample of the audio data 21 may be defined by a particular input bit depth, e.g., 16 bits or 24 bits. In one example, the audio encoder 24 may be configured operate on a single channel of the audio data 21 (e.g., mono audio). In another example, the audio encoder 24 may be configured to independently encode two or more channels of the audio data 21. For example, the audio data 21 may include left and right channels for stereo audio. In this example, the audio encoder 24 may be configured to encode the left and right audio channels independently in a dual mono mode. In other examples, the audio encoder 24 may be configured to encode two or more channels of the audio data 21 together (e.g., in a joint stereo mode). For example, the audio encoder 24 may perform certain compression operations by predicting one channel of the audio data 21 based on another channel of the audio data 21.

Regardless of how the channels of the audio data 21 are arranged, the audio encoder 24 invokes a transform unit 100 to process the audio data 21. The transform unit 100 is configured to process the audio data 21 by, at least in part, applying a transform to a frame of the audio data 21 and thereby transform the audio data 21 from a time domain to a frequency domain to produce frequency domain audio data 112.

A frame of the audio data 21 may be represented by a predetermined number of samples of the audio data. In one example, a frame of the audio data 21 may be 1024 samples wide. Different frame widths may be chosen based on the frequency transform being used and the amount of compression desired. The frequency domain audio data 112 may be represented as transform coefficients, where the value of each of the transform coefficients represents an energy of the frequency domain audio data 112 at a particular frequency.

In one example, the transform unit 100 may be configured to transform the audio data 21 into the frequency domain audio data 112 using a modified discrete cosine transform (MDCT). An MDCT is a "lapped" transform that is based on a type-IV discrete cosine transform. The MDCT is considered "lapped" as it works on data from multiple frames. That is, in order to perform the transform using an MDCT, transform unit 100 may include a fifty percent overlap window into a subsequent frame of audio data. The overlapped nature of an MDCT may be useful for data compression techniques, such as audio encoding, as it may reduce artifacts from coding at frame boundaries. The transform unit 100 need not be constrained to using an MDCT but may use other frequency domain transformation techniques for transforming the audio data 21 into the frequency domain audio data 112.

A filter 102 separates the frequency domain audio data 112 into different portions 114. In some examples, the filter 102 may include a subband filter that separates the frequency domain audio data 112 into different subbands. As such, the filter 102 may be referred to as a subband filter 102, and the portion 114 may be referred to as subbands 114. Although described below with respect to the subband filter 102 and the subbands 114, the techniques may be performed with respect to different filters 102 that result in different portions 114.

In any event, each of the subbands 114 includes transform coefficients of the frequency domain audio data 112 in a particular frequency range. For instance, the subband filter 102 may separate the frequency domain audio data 112 into twenty different subbands. In some examples, subband filter 102 may be configured to separate the frequency domain audio data 112 into subbands 114 of uniform frequency ranges. In other examples, subband filter 102 may be configured to separate the frequency domain audio data 112 into subbands 114 of non-uniform frequency ranges.

As one example of non-uniform frequency ranges, the subband filter 102 may be configured to separate the frequency domain audio data 112 into subbands 114 according to the Bark scale. In general, the subbands of a Bark scale have frequency ranges that are perceptually equal distances relative to one another. That is, the subbands of the Bark scale are not equal in terms of frequency range, but rather, are equal in terms of human aural perception. In general, subbands at the lower frequencies will have fewer transform coefficients, as lower frequencies are easier to perceive by the human aural system.

As such, the frequency domain audio data 112 in lower frequency subbands of the subbands 114 is less compressed by the audio encoder 24, as compared to higher frequency subbands. Likewise, higher frequency subbands of the subbands 114 may include more transform coefficients, as higher frequencies are harder to perceive by the human aural system. As such, the frequency domain audio 112 in data in higher frequency subbands of the subbands 114 may be more compressed by the audio encoder 24, as compared to lower frequency subbands.

The audio encoder 24 may be configured to process each of subbands 114 using a subband processing unit 128. That is, the subband processing unit 128 may be configured to process each of subbands separately. The subband processing unit 128 may be configured to perform a gain-shape vector quantization process.

A gain-shape analysis unit 104 may receive the subbands 114 as an input. For each of subbands 114, the gain-shape analysis unit 104 may determine an energy level 116 of each of the subbands 114. That is, each of subbands 114 has an associated energy level 116. The energy level 116 is a scalar value in units of decibels (dBs) that represents the total amount of energy (also called gain) in the transform coefficients of a particular one of subbands 114. The gain-shape analysis unit 104 may separate energy level 116 for one of the subbands 114 from the transform coefficients of the subbands to produce a residual vector 118. The residual vector 118 represents the so-called "shape" of the subband. The shape of the subband may also be referred to as the spectrum of the subband.

An energy quantizer 106 may receive the energy level 116 of the subbands 114 and quantize the energy level 116 of the subbands 114 into a coarse energy 120 and a fine energy 122. As shown in the example of FIG. 2, the energy quantizer 106 may include a prediction/difference ("P/D") unit 130, a coarse quantization ("CQ") unit 132, a summation unit 134, and a fine quantization ("FQ") unit 136. The P/D unit 130 may predict or otherwise identify a difference between energy levels 116 for one of the subbands 114 and another one of the subbands 114 of the same frame of audio data (which may refer to spatial—in the frequency domain—prediction) or a same (or possibly a different) one of the subbands 114 from a different frame (which may be referred to as temporal prediction). The P/D unit 130 may analyze the energy levels 116 in this manner to obtain predicted energy levels 131 ("PEL 131") for each of the subbands 114. The P/D unit 130 may output the predicted energy levels 131 to the coarse quantization unit 132.

The coarse quantization (CQ) unit 132 may represent a unit configured to perform coarse quantization with respect to the predicted energy levels 131 to obtain the coarse energy 120. The coarse quantization unit 132 may output the coarse energy 120 to the bitstream encoder 110 and the summation unit 134. The summation unit 134 may represent a unit configured to obtain a difference of the coarse quantization unit 132 and the predicted energy level 131. The summation unit 134 may output the difference as error 135 to the fine quantization unit 135.

The fine quantization (FQ) unit 132 may represent a unit configured to perform fine quantization with respect to the error 135. The fine quantization may be considered "fine" relative to the coarse quantization performed by the coarse quantization unit 132. That is, the fine quantization unit 132 may quantize according to a step size having a higher resolution than the step size used when performing the coarse quantization, thereby further quantizing the error 135. The fine quantization unit 136 may obtain a fine energy 122 for each for the subbands 122 as a result of performing the fine quantization with respect to the error 135. The fine quantization unit 136 may output the fine energy 122 to the bitstream encoder 110.

In other words, the energy quantizer 106 may perform a two-step quantization process. The energy quantizer 106 may first quantize the energy level 116 with a first number of bits for a coarse quantization process to generate the coarse energy 120. The energy quantizer 106 may generate the coarse energy using a predetermined range of energy levels for the quantization (e.g., the range defined by a maximum and a minimum energy level). The coarse energy 120 approximates the value of the energy level 116.

The energy quantizer 106 may then determine a difference between the coarse energy 120 and the energy level 116. This difference is sometimes called a quantization error. The energy quantizer 106 may then quantize the quantization error using a second number of bits in a fine quantization process to produce the fine energy 122. The number of bits used for the fine quantization bits is determined by the total number of energy-assigned bits minus the number of bits used for the coarse quantization process. When added together, the coarse energy 120 and the fine energy 122 represent a total quantized value of the energy level 116.

An adaptive vector quantizer 108 may be configured to quantize the residual vector 118. In one example, the adaptive vector quantizer 108 may quantize the residual vector using a pyramid vector quantization (PVQ) process to produce the residual ID 124, i.e., one or a plurality of IDs assigned to respective quantization code-vectors. Instead of quantizing each sample separately (e.g., scalar quantization), the adaptive vector quantizer 108 may be configured to quantize a block of samples included in the residual vector 118 (e.g., a shape vector). In some examples, the adaptive vector quantizer 108 may use a Linde-Buzo-Gray (LBG) algorithm to perform the vector quantization. A Linde-Buzo-Gray (LBG) algorithm typically results in less distortion with a fixed available bit-rate compared to scalar quantization. However, any vector quantization processes can be used along with the perceptual audio coding techniques of this disclosure.

For example, the adaptive vector quantizer 108 may use structured vector quantization algorithms reduce storage and computational complexity LGB algorithms. A structured vector quantization may involve performing the quantization based upon a set of structured code-vectors that do not need to be stored explicitly and can be identified functionally. Examples of the structured vector quantizers include Lattice vector quantizers and Pyramid Vector Quantizers (PVQ) as introduced in T. Fischer, "A pyramid vector quantizer," in *IEEE Transactions on Information Theory*, vol. 32, no. 4, pp. 568-583, July 1986. One example of how PVQ may be used is described in A. C. Hung, E. K. Tsern and T. H. Meng, "Error-resilient pyramid vector quantization for image compression," in *IEEE Transactions on Image Processing*, vol. 7, no. 10, pp. 1373-1386, October 1998.

Using PVQ, the adaptive vector quantizer 108 may be configured to map the residual vector 118 to a hyperpyramid (with constant L1 norm) or a hypersphere (with constant L2 norm) and quantize the residual vector 118 upon the underlying structured codebook. The quantization code-vectors are then enumerated and assigned an ID (e.g., the residual ID 124) to be encoded and transmitted. The quality of the mapping drives the accuracy of the quantization, while the number of enumeration code-vectors specifies the shape transmission rate.

Figure 3:
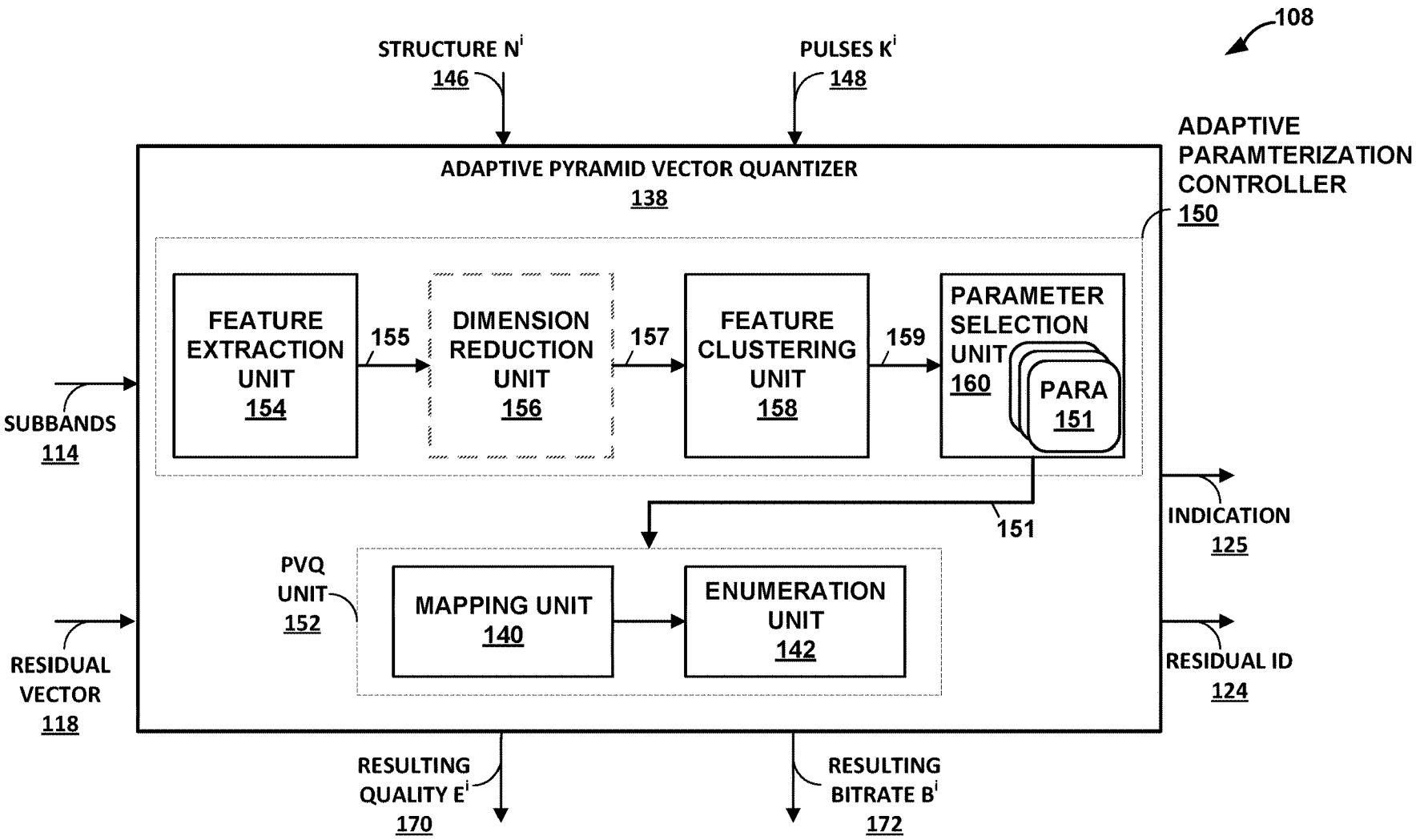
FIG. 3 is a block diagram illustrating an example vector quantizer configured to perform various aspects of the techniques described in this disclosure.

FIG. 3 is a block diagram illustrating an example adaptive vector quantizer 108 configured to perform various aspects of the techniques described in this disclosure. In particular, the adaptive vector quantizer 108 may include an adaptive pyramid vector quantizer 138 that is configured to perform the adaptive pyramid vector quantization (PVQ) of residual vectors of audio data in accordance with various aspects of the techniques described in this disclosure.

The residual vector 118 is input to the adaptive pyramid vector quantizer 138. As discussed above, the residual vector 118 is a residual vector of one of subbands 114 of frequency domain audio data. In operation, the adaptive pyramid vector quantizer 138 generates a residual ID 124 to encode the residual vector 118. As the residual vector 118 is a residual vector of one of subbands 114, the adaptive pyramid vector quantizer 138 may generate a separate residual ID 124 for each of the subbands 114 or the adaptive vector quantizer 108 may include (although not shown in the example of FIG. 3) a separate pyramid vector quantizer 138 for each of the subbands 114. The assignment of residual IDs to the codevectors on a hypersurface (e.g., a hyperpyramid) may be a lossless process.

Figure 4:
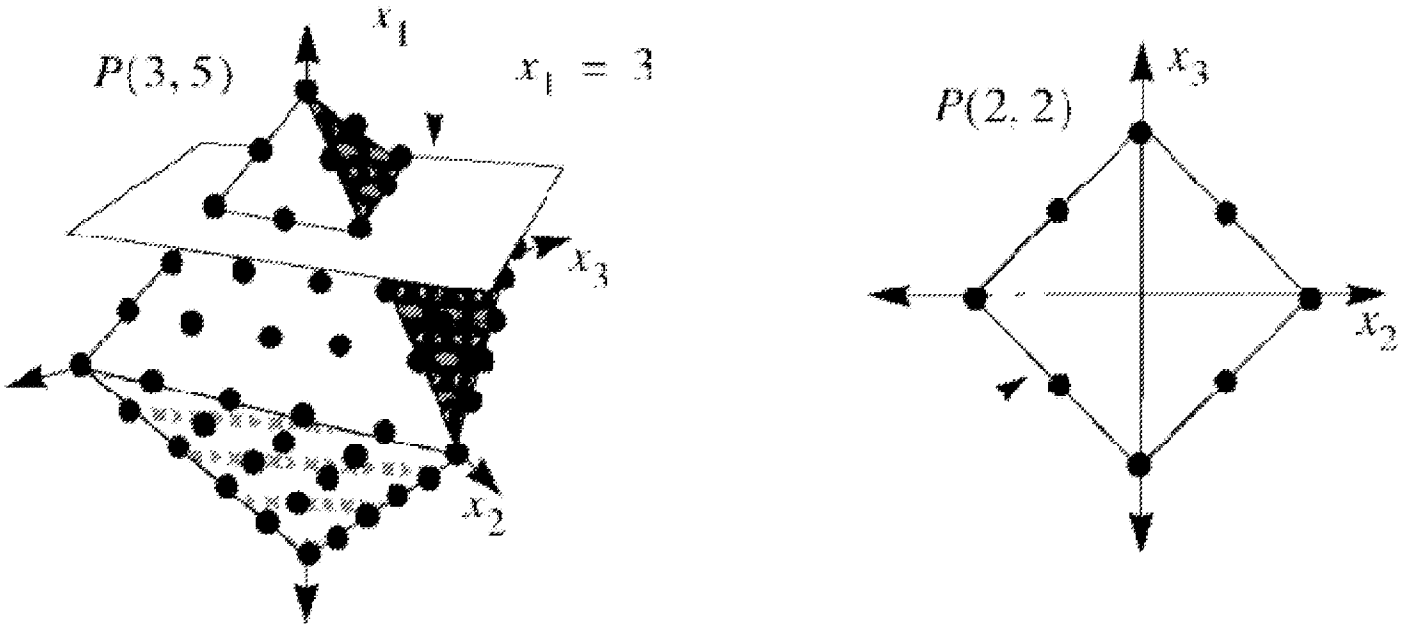
FIG. 4 is a diagram that illustrates an example hyperpyramid used for performing pyramid vector quantization.

As shown in FIG. 3, the adaptive pyramid vector quantizer 138 includes a mapping unit 140 and an enumeration unit 142, which form a PVQ unit 152. To perform PVQ, the mapping unit 140 may map the residual vector 118 onto an N-dimensional hypersurface (e.g., a hyperpyramid) and the enumeration unit 142 may assign a unique identifier (ID) to each codevector on the hypersurface. The mapping of a residual vector may be parameterized by a structure N 146 and pulses K 148. The structure N 146 may represent the number of samples in the residual vector to be quantized (i.e., the number of samples in residual vector 118) and the pulses K 148 may represent the number of pulses to be included on the N-dimensional hypersurface. FIG. 4 is a diagram that illustrates an example hyperpyramid used for performing pyramid vector quantization. In the example of FIG. 4, the hyperpyramid had a structure N value of 3 and a pulse K value of 5.

The level of quantization of the residual vector 118, and thus the loss, is dependent on the number of pulses K 148 used for the subband. The number of pulses K 148 used for a subband is dependent on the number of bits allocated to encoding the residual vector in the subband. Subbands that are allocated higher numbers of bits may be encoded using more pulses, which may result in less distortion (i.e., loss) than subbands that are allocated lower numbers of bits.

The below equations illustrate the relationship between the number of transform coefficients in subband m (represented by $N_m$), the number of pulses used to encode the residual vector in subband m (represented by $K_m$), and the number of bits allocated to encode the residual vector in subband m (represented by $b_m$).

$$V_m \equiv V(N_m, K_m)$$

$$b_m \equiv \log_2 V_m$$

As such, the total number of bits needed to encode the residual vectors for all subbands is defined by the following equation.

$$B \equiv \sum_{m=1}^{M} b_m = \sum_{m=1}^{M} \log_2 V_m = \log_2 \prod_{m=1}^{M} V_m$$

Assume P defines a partition operator over transform space $N^i \equiv \{N_m^i\}_{m=1}^{M}$ with assigned PVQ pulses of $K^i \equiv \{K_m^i\}_{m=1}^{M}$ which correspond to a codebook length of $V^i \equiv \{V_m^i\}_{m=1}^{M}$. For any given mapping algorithm, each partition will result in a different PVQ with different performance.

The human ear has different sensitivities for distortion in different subbands. A level of distortion in one subband may be substantially more noticeable to a person than the same level of distortion in another subband. Therefore, it is desirable for the total bit budget of B to be allocated amongst the various subbands to achieve the lowest level of overall distortion (e.g., to achieve the highest level of overall quality). In equation form, assume resulting quality $E^i$ 170 is a distortion measure obtained by applying a distortion evaluation operator E on $P^i$, defined as:

$$P^i \equiv P(N^i, V^i)$$

Then $$E^i \equiv E(P^i)$$

As such, it is desirable to find a partition optimizing the measure:

$$P^* \equiv \arg\min_{P^i} E^i$$

In some instances, the framework has a fixed table of parameters for PVQ. Lack of an adaptation process may result in several problems, as the vector quantization may attempt to quantize audio data with different contents. The single table used for PVQ may not respond efficiently (in terms of accurately representing the vector) to the entire spectrum of frequencies. The fixed table may incur a fixed distribution of available bits over the spectrum which is independent of the input vector. As such, the fixed PVQ table may suffer from an inability to respond to input content variations.

The techniques described in this disclosure may provide an adaptable framework that may account for audio content variations. One example approach may be to design and use adaptive and dynamic bit allocation algorithms that may provide necessary information on how to change the bit distribution. However, the adaptive and dynamic bit allocation algorithms may suffer from high computation levels which may be impractical when the memory and processing cycle (e.g., MIPS) budget is restrained (e.g., to limit power consumption in mobile, or other power limited, devices). The adaptive PVQ techniques set forth in this disclosure may provide a more efficient approach (relative to the adaptive and dynamic bit allocation algorithms) that may recognize the audio content and change the parameters of PVQ to adapt the bit distribution to best accommodate the recognized audio content.

As further shown in the example of FIG. 3, the adaptive pyramid vector quantizer 138 includes a quantization parameterization controller 150 (which may be referred to as the "controller 150") that may obtain a set of one or more parameters 151 by which to adapt the PVQ unit 152. The use of the term "set" in this disclosure is assumed to refer to one or more elements, and not, unless otherwise indicated, the strict mathematical definitional use of the term "set," which may include zero elements. The PVQ unit 152 includes, as shown in the example of FIG. 3, the above described mapping unit 140 and the enumeration unit 142.

The controller 150 may include a feature extraction unit 154, an optional (hence the dashed lines) dimension reduction unit 156, a feature clustering unit 158, and a parameter selection unit 160. As such, the adaptive parameterization controller 150 may include the following:

1—A feature extraction component (e.g., the feature extraction unit 154), which is responsible for computing the most informative audio content indicators (e.g., the features 155) having the correct information that allows for determination of the class (or, in other words, the category 159) of input audio; and 2—An audio categorization component (e.g., the feature clustering unit 158 and the parameter selection unit 160), which receives the audio features 155/157 and selects the appropriate set of quantization parameters to apply a statically optimal bit distribution.

After performing the MDCT transform and subbanding, the feature mapping algorithm performed by the feature extraction unit 154 of the adaptive parameterization controller 150 may provide a vector of features for the input data to a feature clustering algorithm performed by the feature clustering unit 158 which categorizes the input. The output of the clustering algorithm (e.g., the category 159) is used by the parameter selection unit 160 to select from a finite set of PVQ parameters 151A-151N previously stored. The parameters 151 are loaded to the PVQ unit 152 component accordingly.

In this respect, the techniques may provide a flexible framework to adjust any level of adaptability. Most of the computations will be conducted offline (e.g., clustering training, feature analysis, and PVQ training). As such, the adaptive PVQ techniques may be suitable for low MIPS applications providing adaptive bit allocation.

In operation, the feature extraction unit 154 may represent a unit configured to perform feature extraction with respect to one or more of the subbands 114, which may represent one example of a filtered portion of the audio data 23. Feature extraction may refer to any way by which informative audio content indicators (or, in other words, features) may be extracted to determine to which class (or, in other words, category) of audio the residual vectors correspond.

Examples of feature extraction may include audio data, signal, and spectral analysis, independent component analysis (ICA), kernel methods, information theoretic measurements, compressive feature processes, subspace learning, principal component analysis (PCA), psychoacoustical scaling, spectral mappings, etc. More information can be found in Christopher M. Bishop, *Pattern Recognition and Machine Learning,* Springer, 2006, for further details and examples. The feature extraction unit 154 may in this way obtain features 155 (which may be organized as a vector, and as such may be referred to as a "feature vector 155"). Examples of the features 155 include statistical indicators, such as mean, variance, higher order statistics, in time or frequency domains, spectral characteristics, temporal representations, zero crossing rate, mel frequency cepstral coefficients (MFCC), auto correlation coefficients, psychoacoustic features, human hearing perceptual components, quantization noise, masking thresholds, signal to noise ratio (SNR) and root mean square (RMS) energy, pitch and chroma perception, music elements, such as harmony, pitch, tempo, rhythm, psychoacoustic loudness and intensity, stereo spatial cues, such as interaural level and time differences, connectionist feature representations, such as feature models and parameters based on neural networks, hierarchical features, recursive connections, audio sequence graphs, Hopfield networks, (restricted) Boltzman machines, etc. The feature mapping component (e.g., the feature extraction unit 154) may involve statistical analysis of audio data. One example case of this feature mapping component would be a one-to-one mapping which would reduce to critical bands. The feature extraction unit 154 may output the features 155 to the dimension reduction unit 156.

The dimension reduction unit 156 may represent a unit configured to perform dimension reduction with respect to the features 155 to obtain reduced features 157. The dimension reduction unit 156 may reduce the dimensionality of the features 155 so as to reduce the computations performed during feature clustering by the feature clustering unit 158. By reducing the dimensionality, the number of processor cycles consumed during the subsequent feature clustering may be reduced, resulting in less power consumption and more efficient operation of the source device 12, thereby improving operation of the source device 12 itself.

The dimension reduction unit 156 may perform a linear invertible transform or other type of transform to reduce the dimensionality of the features 155. For example, the dimension reduction unit 156 may perform a principal component analysis (PCA) with respect to the features 155 to identify the principal (or most salient) features 155, thereby reducing the dimensionality of the features 155 (e.g., reducing the number of elements in the feature vector 155) to obtain the reduced features 157. The dimension reduction unit 156 may output the reduced features 157 to the feature clustering unit 158.

Although shown as performing the dimension reduction with respect to the features 155 and outputting the reduced features 157 to the feature clustering unit 158, the controller 150 may, in some examples, invoke the feature clustering unit 158 to perform feature clustering with respect to the features 155 (and not the reduced features 157). As such, the dimension reduction unit 156 may represent a unit configured to optionally optimize feature clustering.

In any event, the feature clustering unit 158 may represent a unit configured to perform feature clustering with respect to the reduced features 157 to identify, from a plurality of categories, a category 159 to which the subbands 114 corresponds. The feature clustering unit 158 may perform, as an example of feature clustering, categorizing the incoming frames of data and discriminating based on the extracted features, maximizing a within-cluster similarity criterion, and minimizing an inter-cluster dissimilarity measure to identify, from the plurality of categories, the category 159. Such discrimination ensures having localized pattern clusters possessing similar structures of redundancy. In its most straightforward implementation, conventional unsupervised clustering solutions can be used. Examples include K-means clustering, hierarchical clustering, fuzzy clustering, etc. A more efficient feature clustering system may consider joint criteria not only based on similarity measures in feature space, but also considering compression-oriented pattern recognitions. Such more sophisticated optimizations can incorporate PVQ compression efficiency, quantization performance, and rate-distortion metrics. This can be designed either in an unsupervised fashion or with supervised compression-directed classifications for audio contents. Examples of such tools can also be extended upon linear classifiers, Bayesian classifiers, logistic regression for binary classifications, neural networks, graphical and Markov models, etc. Again, more information concerning feature selection and clustering can be found in Christopher M. Bishop, *Pattern Recognition and Machine Learning*, Springer, 2006. The feature clustering unit 158 may output the category 159 to the parameter selection unit 160.

To further reduce the complexity of the feature clustering, pre-processing algorithms such as PCA can be used to reduce dimensionality. The number of clusters (which is the same, in the one-to-one mapping example, as the number of PVQ tables) can be as small as L=2, depending on the trade-off between quantization performance and memory. Those features should be considered that can be assumed to contain discriminative information for the quantization component under adaptive control.

The parameter selection unit 160 may represent a unit configured to select, based on the category 159, a set of parameters 151 from two or more different sets of parameters 151A-151N (which are shown in the example of FIG. 3 as "PARA 151" for ease of illustration). To facilitate coding efficiency in terms of reducing the number of bits used to represent the residual vector 118 while also attempting to avoid introduction of noise or other artifacts that result in low signal to noise ratios (SNRs), each of the sets of parameters 151A-151N may be individually tailored to a corresponding one of the categories 159. In other words, the different sets of the parameters 151A-151N may undergo statistical analysis so as to adapt the various PVQ tables to best represent the residual vector 118 for the identified category 159. The PVQ tables, which may be one example of the sets of parameters 151, may have predefined structure 146 and pulses 148 for the associated categories 159. The parameter selection unit 160 may output the selected set of parameters 151 to the PVQ unit 152, which may then perform, based on the selected set of parameters 151, PVQ with respect to the residual vector 118 in order to obtain the residual ID 124 in the manner described in more detail above.

The total number of overhead bits will depend on the number of PVQ tables (which again is one example of the sets of parameters 151). In other words, the audio encoder 24 signals an indication 125 identifying which of the sets of parameters 151 was selected for the residual vector 124. The number of different PVQ tables thereby requires a certain number of bits to be used for the indication 125 to uniquely identify each of the different PVQ tables. The number of bits used for the indication 125 may, as one example, require an increase of log 2(L) bits in each frame in the bitrate, where L denotes the number of different PVQ tables.

The clustering component and PVQ parameters selection will depend on data. Feature clustering computations may only be added at the encoder 24. The decoder 44 does not perform clustering as described in more detail below.

In other words, there are several sets of quantization parameters 151 obtained offline and stored for each specific type of audio content. An audio categorization component (e.g., the adaptive parameterization controller 150) identifies the type and recalls the appropriate parameters 151 accordingly. In this respect, various aspects of the adaptive PVQ techniques may provide a trade-off between the precision in adaptation of the encoding versus computation and memory requirements. Although described in the context of a personal area network (PAN), the techniques may be applied within any audio coding system that allows for adaptation in real-time or near-real-time.

Although not described in detail, the adaptive PVQ techniques may be utilized and modified to extract the L sets of PVQ parameters 151 optimized for a given cluster 159. This can be conducted offline, but memory usage may linearly increase by considering more clusters.

In a more compression-efficient realization of the foregoing techniques, online incremental learning algorithms are used to optimize the PVQ tables (which may also be referred to as "PVQ codebooks"), mapping and enumeration, in real-time or near-real-time. This happens as new instances of their associated categories are observed. This added level of intelligence along with an independent feature space definition, relaxes the need for transmission of signaling information, as the updating can take place in both encoder and decoder. As a result, the foregoing adaptive learning aspects of the techniques may increase the compression and streaming efficiency. For example, conventional stochastic gradient descent rules can be used to increment/decrement the number of pulses in the opposite direction of a gradient of the current PVQ/coding distortion measures linearly combined with the categorization likelihood function.

An unsupervised online updated version of the PVQ may be defined mathematically according to the following pseudocode:

If E(C(K)) is a measure for coding under a number of pulses K: then in each frame t:

$$K^{(t)} \leftarrow K^{(t-1)} - \gamma \frac{\Delta E}{\Delta K}\Big|_{K=K^{(t-1)}}$$

where $$\Delta E = E(C(K^{(t)})) - E(C(K^{(t-1)})).$$

If:

x: input feature vector $C_x$: assigned cluster $$E_x = [E(x)|\mathrm{PVQ}(T_x(N_x, K_x))]$$

$$P_l = P(C_l|C_x)\text{: Likelihood of clustering}$$

$$E_{l|x} = [E(x)|\mathrm{PVQ}(T_l(N_l, K_l))]$$

Then:

$E = \Sigma_{l=1}^{L} P_l \cdot E_{l|x}$, where x: feature vector at the frame

Figure 5:
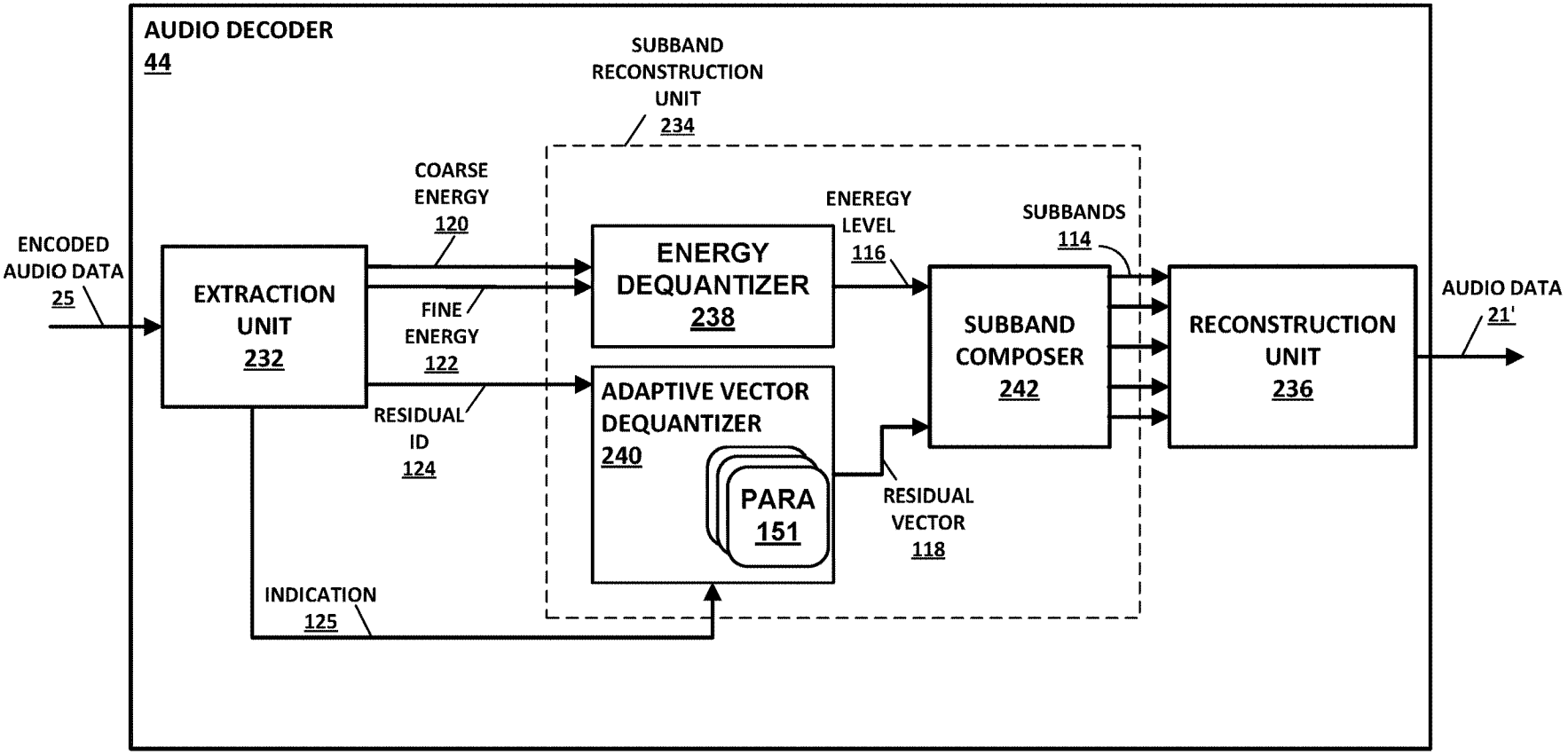
FIG. 5 is a block diagram illustrating the audio decoder of FIG. 1 in more detail.

FIG. 5 is a block diagram illustrating the audio decoder of FIG. 1 in more detail. As shown in the example of FIG. 5, the audio decoder 44 includes an extraction unit 232, a subband reconstruction unit 234, and a reconstruction unit 236.

The extraction unit 232 may represent a unit configured to extract the coarse energy 120, the fine energy 122, the residual ID 124, and the indication 125 from the encoded audio data 25. In some examples, the extraction unit 232 may extract the coarse energy 120, the fine energy 122, the residual ID 124, and the indication 125 based on one or more syntax elements specified in the encoded audio data 25. The extraction unit 232 may output the coarse energy 120, the fine energy 122, the residual ID 124, and the indication 125 to the subband reconstruction unit 234.

The subband reconstruction unit 234 may represent a unit configured to operate in a manner that is reciprocal to the operation of the subband processing unit 128 of the audio encoder 24 shown in the example of FIG. 2. The subband reconstruction unit 234 may, in other words, reconstruct the subbands from the coarse energy 120, the fine energy 122, and the residual ID 124. The subband reconstruction unit 234 may include an energy dequantizer 238, a vector dequantizer 240, and a subband composer 242.

The energy dequantizer 238 may represent a unit configured to perform dequantization in a manner reciprocal to the quantization performed by the energy quantizer 106. The energy dequantizer 238 may perform dequantization with respect to the coarse energy 122 and the fine energy 122 to obtain the predicted/difference energy levels, on which the energy dequantizer 238 may perform inverse prediction or difference calculations to obtain the energy level 116. The energy dequantizer 238 may output the energy level 116 to the subband composer 242.

The adaptive vector dequantizer 240 may represent a unit configured to perform adaptive vector dequantization in a manner reciprocal to the adaptive vector quantization performed by the adaptive vector quantizer 108. The adaptive vector dequantizer 240 may perform, based on the indication 125, pyramid vector dequantization (PVD) with respect to the residual ID 124 to obtain the residual vector 118. That is, the adaptive vector dequantizer 240 may obtain, from a plurality of sets of inverse PVQ parameters 151 and based on the indication 125, a set of inverse PVQ parameters 151. The adaptive vector dequantizer 240 may next perform, based on the set of inverse PVQ parameters 151, inverse PVQ with respect to the residual identifier 124 to obtain the residual vector 118. In the example where the parameters 151 represent a PVQ table, the inverse PVQ parameters are the same as the PVQ parameters, and as such the inverse PVQ parameters are shown in the example of FIG. 5 as being the same as the PVQ parameters shown in the example of FIG. 3. The vector dequantizer 240 may output the residual vector 118 to the subband composer 242.

The subband composer 242 may represent a unit configured to operate in a manner reciprocal to the gain-shape analysis unit 104. As such, the subband composer 242 may perform inverse gain-shape analysis with respect to the energy level 116 and the residual vector 118 to obtain the subbands 114. The subband composer 242 may output the subbands 114 to the reconstruction unit 236.

The reconstruction unit 236 may represent a unit configured to reconstruct, based on the subbands 114, the audio data 21'. The reconstruction unit 236 may, in other words, perform inverse subband filtering in a manner reciprocal to the subband filtering applied by the subband filter 102 to obtain the frequency domain audio data 112. The reconstruction unit 236 may next perform an inverse transform in a manner reciprocal to the transform applied by the transform unit 100 to obtain the audio data 21'.

In this way, the audio decoder 44 may obtain, from the bitstream 25 (which may also be referred to as "encoded audio data 25"), a residual identifier 124 representative of the audio data. The audio decoder 44 may also obtain, from the bitstream 25, an indication 125 of pyramid vector quantization (PVQ) parameters. The audio decoder 44 may obtain, from a plurality of sets of inverse PVQ parameters 151 and based on the indication, a set of inverse PVQ parameters 151. Based on the set of inverse PVQ parameters 151, the audio decoder 44 may then perform inverse PVQ with respect to the residual identifier 124 to obtain the audio data (e.g., in the form of the residual vector 118), which is then used to reconstruct the audio data 21'.

Figure 6:
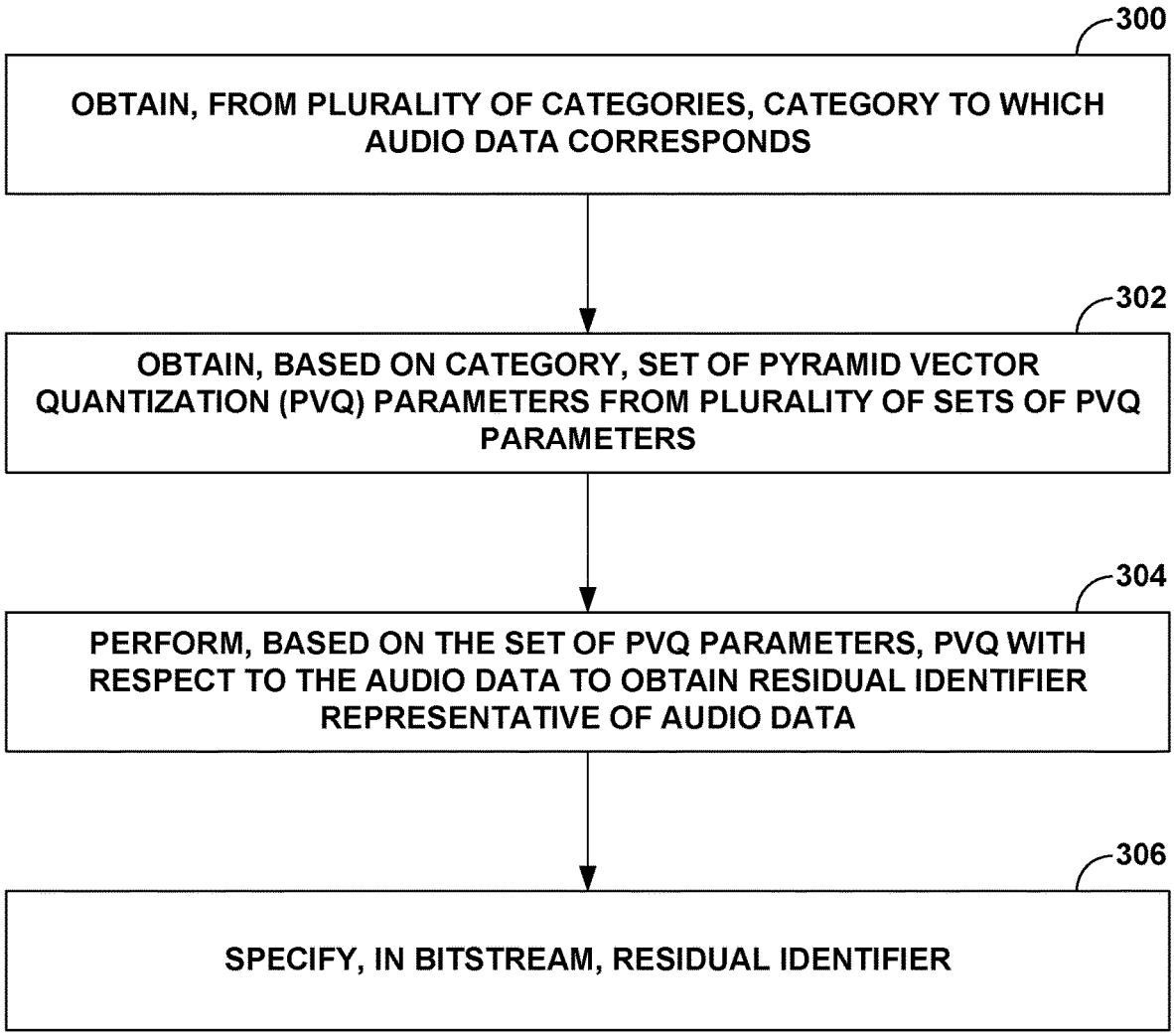
FIG. 6 is a flowchart illustrating example operation of the source device of FIG. 1 in performing various aspects of the techniques described in this disclosure.

FIG. 6 is a flowchart illustrating example operation of the source device 12 of FIG. 1 in performing various aspects of the adaptive PVQ techniques described in this disclosure. The source device 12 may invoke the audio encoder 24, which may perform various aspects of the adaptive PVQ techniques described in this disclosure.

The audio encoder 24 may, as described above in more detail, first obtain, from a plurality of categories 159, a category 159 to which the audio data 23 (e.g., in the form of the subbands 114) corresponds (300). The audio encoder 24 may next obtain, based on the category 159, a set of pyramid vector quantization (PVQ) parameters 151 from a plurality of sets of PVQ parameters 151 (302). The audio encoder 24 may perform, based on the set of PVQ parameters 151, PVQ with respect to the audio data 23 (e.g., in the form of the residual vector 118) to obtain the residual identifier 124 representative of the audio data 23 (304). The audio encoder 24 may specify, in the bitstream 25, the residual identifier 124 (306).

In this way, the audio encoder 24 may perform the adaptive PVQ techniques so as to improve operation of the audio encoder 24 itself. That is, the adaptive PVQ techniques may enable the audio encoder 24 to more efficiently compress the residual vector 118 in a manner that targets a particular category 159 to which the audio data 23 corresponds. The more efficient compression may result in less bits used to represent the residual vector 118 while also better preserving the soundfield represented by the audio data 23. The less bits used to represent the residual vector 118 may promote more efficient storage and transmission within the audio encoder 24 (via registers/local memory, and via internal busses), thereby potentially reducing power consumption and improving the speed with which the audio encoder 24 may process residual vectors 118.

Figure 7:
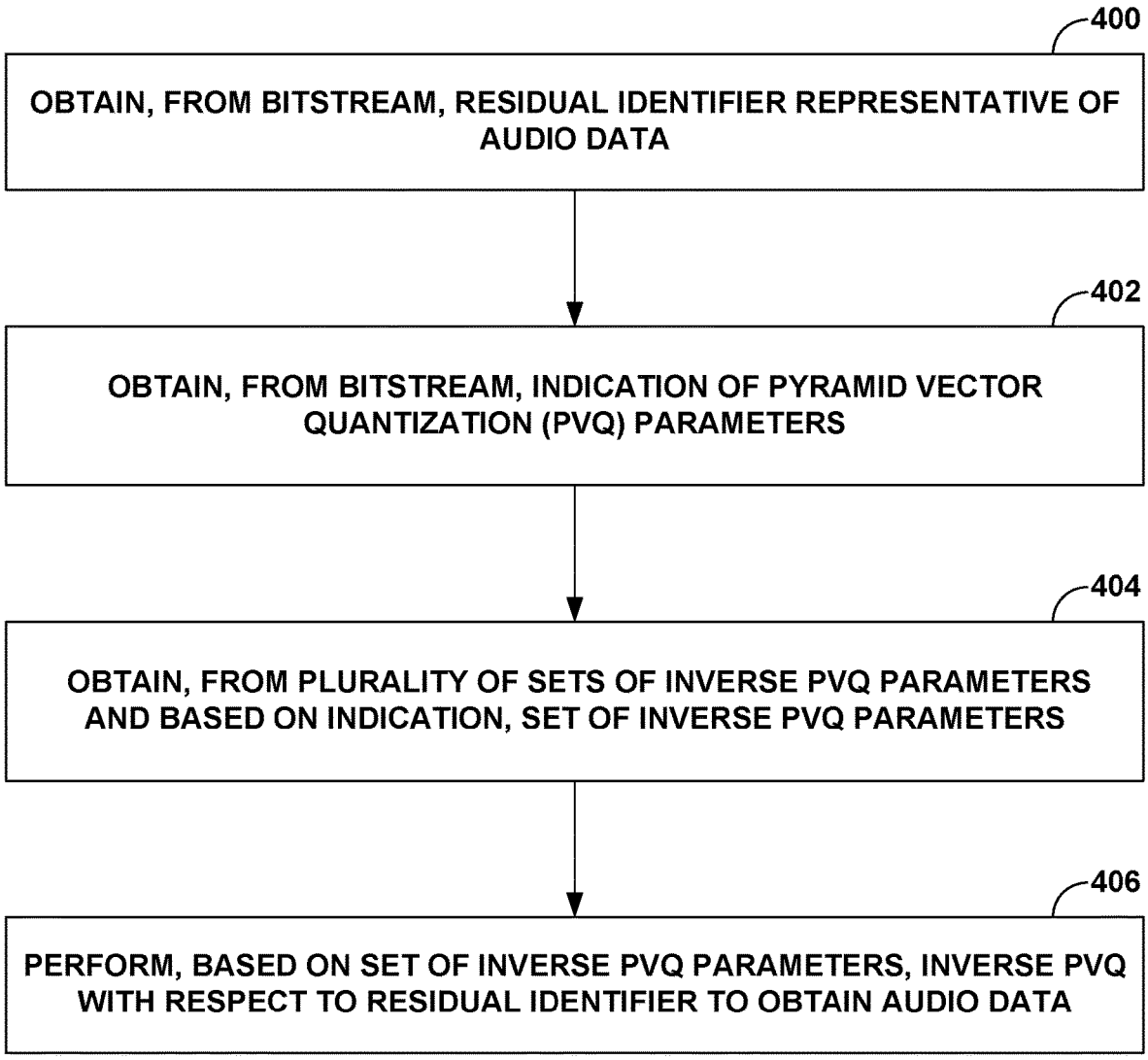
FIG. 7 is a flowchart illustrating example operation of the sink device of FIG. 1 in performing various aspects of the techniques described in this disclosure.

FIG. 7 is a flowchart illustrating example operation of the sink device 14 of FIG. 1 in performing various aspects of the adaptive PVQ techniques described in this disclosure. The sink device 14 may invoke the audio decoder 44, which may perform various aspects of the adaptive PVQ techniques described in this disclosure.

As described above, the audio decoder 44 may obtain, from the bitstream 25 (which may also be referred to as "encoded audio data 25"), a residual identifier 124 representative of the audio data (400). The audio decoder 44 may also obtain, from the bitstream 25, an indication 125 of pyramid vector quantization (PVQ) parameters (402). The audio decoder 44 may obtain, from a plurality of sets of inverse PVQ parameters 151 and based on the indication 125, a set of inverse PVQ parameters 151 (404). Based on the set of inverse PVQ parameters 151, the audio decoder 44 may then perform inverse PVQ with respect to the residual identifier 124 to obtain the audio data (e.g., in the form of the residual vector 118), which is then used to reconstruct the audio data 21' (406).

The foregoing techniques may be performed in various types of audio coding contexts. One example context includes a personal area network (PAN—e.g., Bluetooth) audio streaming context in which a source device (e.g., a mobile phone) establishes a wireless Bluetooth connection with a sink device (e.g., a wireless headset). Prior to sending the audio data via the Bluetooth connection, the audio encoder may perform the foregoing encoding techniques to compress the audio data, generating a representative bitstream to be sent via the Bluetooth connection. The sink device may receive the bitstream and perform the foregoing decoding techniques to decompress the audio data and output the speaker feeds to one or more transducers (or, in other words, speakers).

Figure 8:
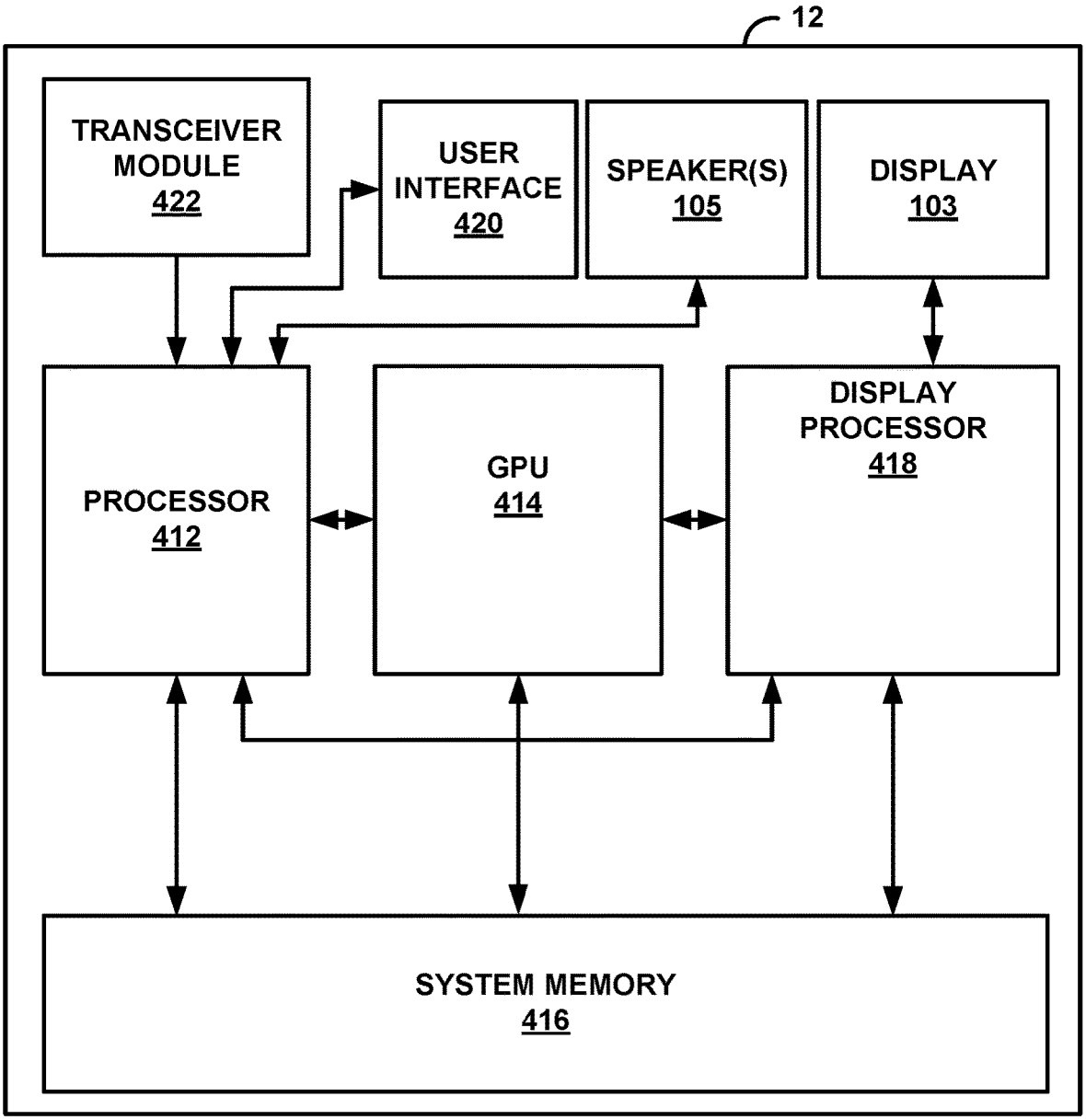
FIG. 8 is a block diagram illustrating example components of the source device shown in the example of FIG. 1.

FIG. 8 is a block diagram illustrating example components of the source device 12 shown in the example of FIG. 1. In the example of FIG. 8, the source device 12 includes a processor 412, a graphics processing unit (GPU) 414, system memory 416, a display processor 418, one or more integrated speakers 105, a display 103, a user interface 420, and a transceiver module 422. In examples where the source device 12 is a mobile device, the display processor 418 is a mobile display processor (MDP). In some examples, such as examples where the source device 12 is a mobile device, the processor 412, the GPU 414, and the display processor 418 may be formed as an integrated circuit (IC).

For example, the IC may be considered as a processing chip within a chip package and may be a system-on-chip (SoC). In some examples, two of the processors 412, the GPU 414, and the display processor 418 may be housed together in the same IC and the other in a different integrated circuit (i.e., different chip packages) or all three may be housed in different ICs or on the same IC. However, it may be possible that the processor 412, the GPU 414, and the display processor 418 are all housed in different integrated circuits in examples where the source device 12 is a mobile device.

Examples of the processor 412, the GPU 414, and the display processor 418 include, but are not limited to, fixed function and/or programmable processing circuitry such as one or more digital signal processors (DSPs), general purpose microprocessors, application specific integrated circuits (ASICs), field programmable logic arrays (FPGAs), or other equivalent integrated or discrete logic circuitry. The processor 412 may be the central processing unit (CPU) of the source device 12. In some examples, the GPU 414 may be specialized hardware that includes integrated and/or discrete logic circuitry that provides the GPU 414 with massive parallel processing capabilities suitable for graphics processing. In some instances, GPU 414 may also include general purpose processing capabilities, and may be referred to as a general-purpose GPU (GPGPU) when implementing general purpose processing tasks (i.e., non-graphics related tasks). The display processor 418 may also be specialized integrated circuit hardware that is designed to retrieve image content from the system memory 416, compose the image content into an image frame, and output the image frame to the display 103.

The processor 412 may execute various types of the applications 20. Examples of the applications 20 include web browsers, e-mail applications, spreadsheets, video games, other applications that generate viewable objects for display, or any of the application types listed in more detail above. The system memory 416 may store instructions for execution of the applications 20. The execution of one of the applications 20 on the processor 412 causes the processor 412 to produce graphics data for image content that is to be displayed and the audio data 21 that is to be played (possibly via integrated speaker 105). The processor 412 may transmit graphics data of the image content to the GPU 414 for further processing based on and instructions or commands that the processor 412 transmits to the GPU 414.

The processor 412 may communicate with the GPU 414 in accordance with a particular application processing interface (API). Examples of such APIs include the DirectX® API by Microsoft®, the OpenGL® or OpenGL ES® by the Khronos group, and the OpenCL™; however, aspects of this disclosure are not limited to the DirectX, the OpenGL, or the OpenCL APIs, and may be extended to other types of APIs. Moreover, the techniques described in this disclosure are not required to function in accordance with an API, and the processor 412 and the GPU 414 may utilize any technique for communication.

The system memory 416 may be the memory for the source device 12. The system memory 416 may comprise one or more computer-readable storage media. Examples of the system memory 416 include, but are not limited to, a random-access memory (RAM), an electrically erasable programmable read-only memory (EEPROM), flash memory, or other medium that can be used to carry or store desired program code in the form of instructions and/or data structures and that can be accessed by a computer or a processor.

In some examples, the system memory 416 may include instructions that cause the processor 412, the GPU 414, and/or the display processor 418 to perform the functions ascribed in this disclosure to the processor 412, the GPU 414, and/or the display processor 418. Accordingly, the system memory 416 may be a computer-readable storage medium having instructions stored thereon that, when executed, cause one or more processors (e.g., the processor 412, the GPU 414, and/or the display processor 418) to perform various functions.

The system memory 416 may include a non-transitory storage medium. The term "non-transitory" indicates that the storage medium is not embodied in a carrier wave or a propagated signal. However, the term "non-transitory" should not be interpreted to mean that the system memory 416 is non-movable or that its contents are static. As one example, the system memory 416 may be removed from the source device 12 and moved to another device. As another example, memory, substantially similar to the system memory 416, may be inserted into the source device 12. In certain examples, a non-transitory storage medium may store data that can, over time, change (e.g., in RAM).

The user interface 420 may represent one or more hardware or virtual (meaning a combination of hardware and software) user interfaces by which a user may interface with the source device 12. The user interface 420 may include physical buttons, switches, toggles, lights or virtual versions thereof. The user interface 420 may also include physical or virtual keyboards, touch interfaces—such as a touchscreen, haptic feedback, and the like.

The processor 412 may include one or more hardware units (including so-called "processing cores") configured to perform all or some portion of the operations discussed above with respect to one or more of the mixing unit 22, the audio encoder 24, the wireless connection manager 26, and the wireless communication units 30. The transceiver module 422 may represent a unit configured to establish and maintain the wireless connection between the source device 12 and the sink device 14. The transceiver module 422 may represent one or more receivers and one or more transmitters capable of wireless communication in accordance with one or more wireless communication protocols. The transceiver module 422 may perform all or some portion of the operations of one or more of the wireless connection manager 26 and the wireless communication units 30.

Figure 9:
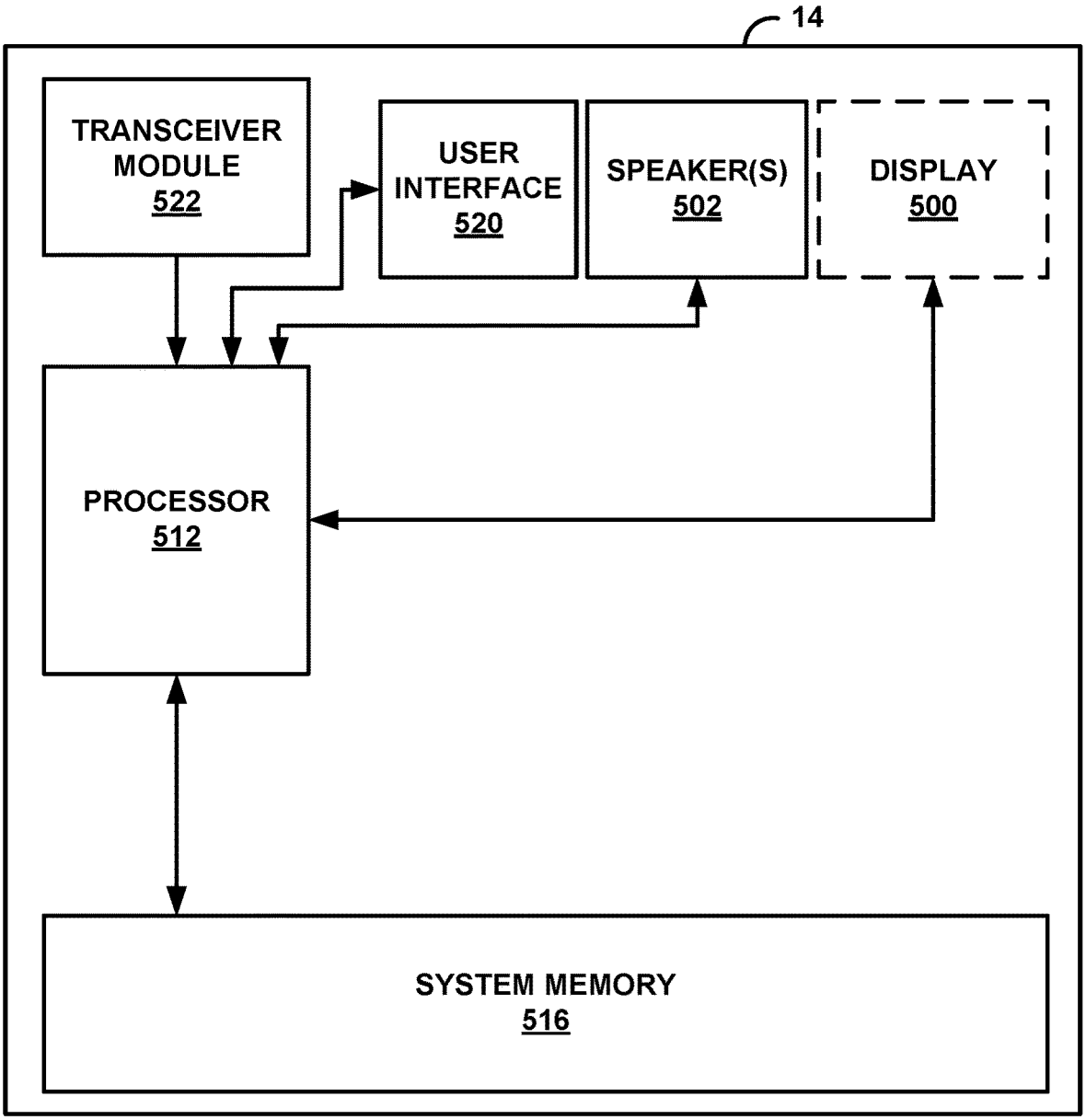
FIG. 9 is a block diagram illustrating exemplary components of the sink device shown in the example of FIG. 1.

FIG. 9 is a block diagram illustrating exemplary components of the sink device 14 shown in the example of FIG. 1. Although the sink device 14 may include components similar to that of the source device 12 discussed above in more detail with respect to the example of FIG. 8, the sink device 14 may, in certain instances, include only a subset of the components discussed above with respect to the source device 12.

In the example of FIG. 9, the sink device 14 includes one or more speakers 502, a processor 512, a system memory 516, a user interface 520, and a transceiver module 522. The processor 512 may be similar or substantially similar to the processor 412. In some instances, the processor 512 may differ from the processor 412 in terms of total processing capacity or may be tailored for low power consumption. The system memory 516 may be similar or substantially similar to the system memory 416. The speakers 502, the user interface 520, and the transceiver module 522 may be similar to or substantially similar to the respective speakers 402, user interface 420, and transceiver module 422. The sink device 14 may also optionally include a display 500, although the display 500 may represent a low power, low resolution (potentially a black and white LED) display by which to communicate limited information, which may be driven directly by the processor 512.

The processor 512 may include one or more hardware units (including so-called "processing cores") configured to perform all or some portion of the operations discussed above with respect to one or more of the wireless connection manager 40, the wireless communication units 42, and the audio decoder 44. The transceiver module 522 may represent a unit configured to establish and maintain the wireless connection between the source device 12 and the sink device 14. The transceiver module 522 may represent one or more receivers and one or more transmitters capable of wireless communication in accordance with one or more wireless communication protocols. The transceiver module 522 may perform all or some portion of the operations of one or more of the wireless connection manager 40 and the wireless communication units 28.

The foregoing techniques may be performed with respect to any number of different contexts and audio ecosystems. A number of example contexts are described below, although the techniques should be limited to the example contexts. One example audio ecosystem may include audio content, movie studios, music studios, gaming audio studios, channel-based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel-based audio content (e.g., in 2.0, 5.1, and 7.1) such as by using a digital audio workstation (DAW). The music studios may output channel-based audio content (e.g., in 2.0, and 5.1) such as by using a DAW. In either case, the coding engines may receive and encode the channel-based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel-based audio content for output by the delivery systems. Another example context in which the techniques may be performed comprises an audio ecosystem that may include broadcast recording audio objects, professional audio systems, consumer on-device capture, high-order ambisonics (HOA) audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into various representations for playback by one or more of the playback elements. For instance, a user of the mobile device may record (acquire a soundfield of) a live event (e.g., a meeting, a conference, a play, a concert, etc.), and code the recording into various representation, including higher order ambisonic HOA representations.

The mobile device may also utilize one or more of the playback elements to playback the coded soundfield. For instance, the mobile device may decode the coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a headset or headphones, e.g., to create realistic binaural sound.

In some examples, a particular mobile device may both acquire a soundfield and playback the same soundfield at a later time. In some examples, the mobile device may acquire a soundfield, encode the soundfield, and transmit the encoded soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of audio signals. For instance, the one or more DAWs may include audio plugins and/or tools which may be configured to operate with (e.g., work with) one or more game audio systems. In some examples, the game studios may output new stem formats that support audio format. In any case, the game studios may output coded audio content to the rendering engines which may render a soundfield for playback by the delivery systems.

The mobile device may also, in some instances, include a plurality of microphones that are collectively configured to record a soundfield, including 3D soundfields. In other words, the plurality of microphone may have X, Y, Z diversity. In some examples, the mobile device may include a microphone which may be rotated to provide X, Y, Z diversity with respect to one or more other microphones of the mobile device.

A ruggedized video capture device may further be configured to record a soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a soundfield that represents the action all around the user (e.g., water crashing behind the user, another rafter speaking in front of the user, etc.).

The techniques may also be performed with respect to an accessory enhanced mobile device, which may be configured to record a soundfield, including a 3D soundfield. In some examples, the mobile device may be similar to the mobile devices discussed above, with the addition of one or more accessories. For instance, a microphone, including an Eigen microphone, may be attached to the above noted mobile device to form an accessory enhanced mobile device. In this way, the accessory enhanced mobile device may capture a higher quality version of the soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a soundfield, including a 3D soundfield. Moreover, in some examples, headphone playback devices may be coupled to a decoder via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the soundfield, including 3D soundfields, of the sports game may be acquired (e.g., one or more microphones and/or Eigen microphones may be placed in and/or around the baseball stadium). HOA coefficients corresponding to the 3D soundfield may be obtained and transmitted to a decoder, the decoder may reconstruct the 3D soundfield based on the HOA coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the source device 12 may perform a method or otherwise comprise means to perform each step of the method for which the source device 12 is described above as performing. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the source device 12 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

Likewise, in each of the various instances described above, it should be understood that the sink device 14 may perform a method or otherwise comprise means to perform each step of the method for which the sink device 14 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the sink device 14 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), fixed function processor, general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some examples, the functionality described herein may be provided within dedicated hardware and/or software modules configured for encoding and decoding or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various aspects of the techniques have been described. These and other aspects of the techniques are within the scope of the following claims.

What is claimed is:

1. A source device configured to process audio data to obtain a bitstream, the source device comprising:

a memory configured to store the audio data; and one or more processors configured to:

obtain, from a plurality of categories, a category to which the audio data corresponds;

obtain, based on the category, a set of pyramid vector quantization (PVQ) parameters from a plurality of sets of PVQ parameters;

perform, based on the set of PVQ parameters, PVQ with respect to the audio data to obtain a residual identifier representative of the audio data; and specify, in the bitstream, the residual identifier.

2. The source device of claim 1, wherein the one or more processors are further configured to perform feature extraction with respect to the audio data to obtain a feature, and wherein the one or more processors are configured to obtain, based on the feature and from the plurality of categories, the category to which the audio data corresponds.

3. The source device of claim 1, wherein the one or more processors are further configured to perform feature extraction with respect to the audio data to obtain a feature, and wherein the one or more processors are configured to perform, based on the feature, audio clustering to identify, from the plurality of categories, the category to which the audio data corresponds.

4. The source device of claim 1, wherein the one or more processors are further configured to:

perform feature extraction with respect to the audio data to obtain a feature, and perform dimension reduction with respect to the feature to obtain a reduced feature, and wherein the one or more processors are configured to perform, based on the reduced feature, audio clustering to identify, from the plurality of categories, the category to which the audio data corresponds.

5. The source device of claim 4, wherein the one or more processors are configured to perform a principal component analysis with respect to the feature to obtain the reduced feature.

6. The source device of claim 1, wherein the one or more processors are further configured to apply a filter to the audio data to obtain a filtered portion of the audio data, and wherein the one or more processors are configured to obtain, from the plurality of categories, the category to which the filtered portion of the audio data corresponds.

7. The source device of claim 6, wherein the filter comprises a subband filter, and wherein the filtered portion of the audio data comprises a subband of the audio data.

8. The source device of claim 1, wherein the one or more processors are further configured to specify, in the bitstream, an indication of the set of PVQ parameters used when performing the PVQ with respect to the audio data.

9. The source device of claim 1, wherein the audio data is defined in a spatial domain, wherein the one or more processors are further configured to:

apply a transform to the audio data to obtain transformed audio data, the transformed audio data defined in a frequency domain, and apply a filter to the transformed audio data to obtain a filtered portion of the transformed audio data, and wherein the one or more processors are configured to obtain, from the plurality of categories, the category to which the filtered portion of the transformed audio data corresponds.

10. The source device of claim 9, wherein the filter comprises a subband filter, and wherein the filtered portion of the transformed audio data comprises a subband of the transformed audio data.

11. The source device of claim 9, wherein the transform comprises a modified discrete cosine transform (MDCT).

12. The source device of claim 1, further comprising a transceiver configured to transmit, in accordance with a wireless communication protocol, the bitstream via a wireless connection.

13. The source device of claim 12, wherein the wireless communication protocol comprises a personal area network wireless communication protocol.

14. The source device of claim 13, wherein the personal area network wireless communication protocol comprises a Bluetooth® wireless communication protocol.

15. A method of processing audio data to obtain a bitstream, the method comprising:

obtaining, from a plurality of categories, a category to which the audio data corresponds;

obtaining, based on the category, a set of pyramid vector quantization (PVQ) parameters from a plurality of sets of PVQ parameters;

performing, based on the set of PVQ parameters, PVQ with respect to the audio data to obtain a residual identifier representative of the audio data; and specifying, in the bitstream, the residual identifier.

16. A sink device configured to process a bitstream representative of audio data, the sink device comprising:

a memory configured to store at least a portion of the bitstream; and one or more processors configured to:

obtain, from the bitstream, a residual identifier representative of the audio data;

obtain, from the bitstream, an indication of pyramid vector quantization (PVQ) parameters;

obtain, from a plurality of sets of inverse PVQ parameters and based on the indication, a set of inverse PVQ parameters, wherein each of the plurality of sets of inverse PVQ parameters corresponds to a different one of a plurality of categories to which the audio data corresponds; and perform, based on the set of inverse PVQ parameters, inverse PVQ with respect to the residual identifier to obtain the audio data.

17. The sink device of claim 16, wherein the audio data comprises a filtered portion of the audio data;

wherein the residual identifier represents a residual vector of the filtered portion of the audio data, and wherein the one or more processors are configured to perform, based on the set of inverse PVQ parameters, the inverse PVQ with respect to the residual identifier to obtain the residual vector.

18. The sink device of claim 16, wherein the audio data comprises a filtered portion of the audio data;

wherein the residual identifier represents a residual vector of the filtered portion of the audio data, wherein the one or more processors are configured to perform, based on the set of inverse PVQ parameters, the inverse PVQ with respect to the residual identifier to obtain the residual vector, and wherein the one or more processors are further configured to obtain, based on a quantized energy specified in the bitstream and the residual vector, the audio data.

19. The sink device of claim 16, wherein the audio data comprises a filtered portion of the audio data;

wherein the residual identifier represents a residual vector of the filtered portion of the audio data, wherein the one or more processors are configured to perform, based on the set of inverse PVQ parameters, the inverse PVQ with respect to the residual identifier to obtain the residual vector, and wherein the one or more processors are further configured to:

obtain, based on a quantized energy specified in the bitstream and the residual vector, a subband defined in a frequency domain;

apply an inverse transform with respect to the subband to obtain a portion of the audio data, the portion of the audio data defined in a spatial domain; and obtain, based on the portion of the audio data, the audio data.

20. The sink device of claim 19, wherein the inverse transform comprises an inverse modified discrete cosine transform (iMDCT).

21. The sink device of claim 16, further comprising a transceiver configured to receive, in accordance with a wireless communication protocol, the bitstream via a wireless connection.

22. The sink device of claim 21, wherein the wireless communication protocol comprises a personal area network wireless communication protocol.

23. The sink device of claim 22, wherein the personal area network wireless communication protocol comprises a Bluetooth® wireless communication protocol.

24. The sink device of claim 16, wherein the one or more processors are further configured to:

render the audio data to one or more speaker feeds; and output the speaker feeds to one or more speakers.

25. The sink device of claim 16, wherein the one or more processors are further configured to render the audio data to one or more speaker feeds, and wherein the sink device includes one or more speakers that reproduce, based on the speaker feeds, a soundfield.

26. A method of processing a bitstream representative of audio data, the method comprising:

obtaining, from the bitstream, a residual identifier representative of the audio data;

obtaining, from the bitstream, an indication of pyramid vector quantization (PVQ) parameters;

obtaining, from a plurality of sets of inverse PVQ parameters and based on the indication, a set of inverse PVQ parameters, wherein each of the plurality of sets of inverse PVQ parameters corresponds to a different one of a plurality of categories to which the audio data corresponds; and performing, based on the set of inverse PVQ parameters, inverse PVQ with respect to the residual identifier to obtain the audio data.

* * * * *